US009289884B2

(12) United States Patent
Patel et al.

(10) Patent No.: US 9,289,884 B2
(45) Date of Patent: Mar. 22, 2016

(54) BAR CLAMP

(76) Inventors: Sajid Patel, Arlington Heights, IL (US); Steve Oshgan, DesPlaines, IL (US)

( * ) Notice: Subject to any disclaimer, the term of this patent is extended or adjusted under 35 U.S.C. 154(b) by 281 days.

(21) Appl. No.: 13/362,979

(22) Filed: Jan. 31, 2012

(65) Prior Publication Data

US 2012/0193853 A1 Aug. 2, 2012

Related U.S. Application Data

(60) Provisional application No. 61/438,207, filed on Jan. 31, 2011.

(51) Int. Cl.
*B25B 1/00* (2006.01)
*B25B 5/06* (2006.01)

(52) U.S. Cl.
CPC ..... *B25B 5/068* (2013.01)

(58) Field of Classification Search
CPC ..... B25B 5/068
USPC ..... 269/6
See application file for complete search history.

(56) References Cited

U.S. PATENT DOCUMENTS 4,926,722 A * 5/1990 Sorensen et al. ..... 81/487
5,022,137 A * 6/1991 Sorensen et al. ..... 29/559
5,222,420 A * 6/1993 Sorensen et al. ..... 81/487
5,494,553 A * 2/1996 Colucci ..... 156/580
6,585,243 B1 * 7/2003 Li ..... 269/6
6,676,120 B1 * 1/2004 Hallbeck et al. ..... 269/6
6,929,253 B2 * 8/2005 Marks ..... 269/6
7,614,617 B2 * 11/2009 Marusiak ..... 269/6
7,735,813 B2 * 6/2010 Geier et al. ..... 269/6
7,784,774 B2 * 8/2010 Fuller et al. ..... 269/6
7,815,175 B2 * 10/2010 Cicenas et al. ..... 269/6
7,896,322 B2 * 3/2011 Geler et al. ..... 269/6
7,942,392 B2 * 5/2011 Geier et al. ..... 269/6
7,954,794 B2 * 6/2011 Fuller et al. ..... 269/6
8,074,340 B2 * 12/2011 Cicenas et al. ..... 29/559
2004/0195746 A1 * 10/2004 Marks ..... 269/6
2006/0125166 A1 * 6/2006 Gerritsen et al. ..... 269/6
2008/0139879 A1 * 6/2008 Olson et al. ..... 600/37
2008/0179801 A1 * 7/2008 Geier et al. ..... 269/6
2009/0224451 A1 * 9/2009 Fuller et al. ..... 269/6
2010/0156013 A1 * 6/2010 Cicenas et al. ..... 269/6
2011/0316210 A1 * 12/2011 Cicenas et al. ..... 269/6

* cited by examiner

*Primary Examiner* — Lee D Wilson
*Assistant Examiner* — Alvin Grant
(74) *Attorney, Agent, or Firm* — David A. Gottardo, Esq.

(57) ABSTRACT

The bar clamp comprises a first jaw connected to a slider, a clamp housing defining a second jaw, a driving mechanism operably associated with the housing and slider to drive the slider, a clamping mechanism operably associated with the housing and slider to brake and hold the slider, and a release mechanism operably associated with the clamping mechanism and slider to release the slider. The bar clamp may utilize different embodiments of a drive mechanism while also utilizing an improved clamping and release mechanism. The drive mechanism thus comprises either a driving lever grip or a driving wedge grip while the clamping mechanism comprises a clamping wedge grip. The clamping wedge grip utilizes pins, cams or balls to brake and hold the slider.

16 Claims, 26 Drawing Sheets

BAR CLAMP

CROSS REFERENCE TO RELATED APPLICATIONS

This application claims priority to U.S. Provisional Application Ser. No. 61/438,207 filed on Jan. 31, 2011.

TECHNICAL FIELD OF THE INVENTION

This invention relates generally to bar clamps and similar devices, and more particularly to one-handed or "quick-clamp" type clamping devices used in the wood-working and construction industries.

BACKGROUND OF THE INVENTION

Bar clamps are used extensively within the wood-working and construction industries to create an inward clamping force, resulting in an inward pressure between opposing jaws of the clamp, to temporarily hold two articles together for bonding to one another via gluing, screwing, nailing, welding or other methods known in the art. Various types of bar clamps are presently known within the industry. One common type of bar clamp is the one-handed or "quick-grip" clamp. Such quick-clamps typically include a trigger or toggle mechanism that is hand actuated to move the opposing jaws, usually connected by a "bar," toward one another to create the inward pressure requisite of holding the articles together. Such clamps also include a hand actuated release mechanism to release the inward pressure of the opposing jaws and to allow the jaws to be moved away from one another.

Presently-available quick-grip clamps, however, suffer numerous disadvantages. One such disadvantage is a failure of these clamps to achieve an increased clamping force and resultant increased clamping pressure between the clamps' opposing jaws. This failure is attributed to the fact that presently-available clamps utilize lever mechanisms having a through opening, defining an interior contact surface to grip opposing sides of the clamp's bar, in creating the requisite jaw pressure. Because one-handed bar clamps typically utilize rectangular-shaped bars to connect the opposing jaws together, it is functionally advantageous that the lever-mechanisms of these clamps grip the sides of the rectangle having the smaller corner-to-corner dimensions. Gripping the sides of the rectangle having the smaller corner-to-corner dimensions allows the lever to grip the bar at a reduced angle, which makes the mechanism easier to operate. However, gripping the smaller corner-to-corner dimensions of a given rectangle results in a reduced frictional area, thereby resulting in reduced clamping strength.

Another such disadvantage is a failure of the presently available quick-grip clamps to maintain initially-created clamping forces over time. Presently-available quick grip clamps utilize a driving lever mechanism to drive the jaws of the clamp together and a locking lever mechanism to hold the jaws in place, once the driving mechanism is released. The disadvantage with the locking lever mechanism is that, for the locking lever to move in relation to the connecting bar, it must have a different angular relationship with the connecting bar during a release function than when it is performing its locking function. This angle change allows for the clamp ends to move away from one another, thus resulting in a loss in clamping pressure generated by the driving lever mechanism.

Another disadvantage is that the locking lever locks onto the connector bar at the 90° corners of its interior contact surface. The locking lever interior contact surface may also contact the bar at either a single point on the top of the bar or at two points on the radii of the bar. The contact geometry of these respective contact surfaces can wear easily and result in slip, thus affecting the clamp's holding strength.

Thus, it would be advantageous if the mechanism of a quick-grip clamp could grip the sides of the rectangular-shaped bar having the longer corner-to-corner dimensions to create increased jaw pressures between the clamps' opposing jaws. It would also be advantageous if the mechanism altogether eliminated the locking lever and resultant slip, thus allowing the clamp to maintain initially-created clamping forces over time. The present invention thus provides these and other advantages.

SUMMARY OF THE INVENTION

The bar clamp comprises a first jaw connected to a slider, a clamp housing defining a second jaw, a driving mechanism operably associated with the housing and slider to drive the slider, a clamping mechanism operably associated with the housing and slider to brake and hold the slider, and a release mechanism operably associated with the clamping mechanism and slider to release the slider. The bar clamp may utilize different embodiments of a drive mechanism while also utilizing an improved clamping and release mechanism. The drive mechanism thus comprises either a driving lever grip or a driving wedge grip while the clamping mechanism comprises a clamping wedge grip. The clamping wedge grip utilizes pins, cams or balls to brake and hold the slider.

The slider is preferably a straight piece of elongated material that adjustably connects the first and second jaws of the clamp to one another. While the slider preferably defines a substantially rectangular cross section, having upper and lower edge surfaces and first and second side surfaces preferably oriented vertically in relation to the clamp, it is understood that the slider may define other cross sections as well, to include square, circular, ovular, triangular, trapezoidal and other cross sections contemplated by those of skill in the art. The slider is comprised of any number of rigid materials, to include metals, plastics, resin-based composite materials and other materials having rigid properties.

The clamp's first jaw preferably comprises a structure having upper and lower ends and is comprised of any number of rigid materials, to include metals, plastics, resin-based composite materials and other materials having rigid properties. The upper end of the jaw defines a jaw surface is preferably comprised of compressible material. It is noted that the first jaw is typically secured to the slider such that the jaw surfaces of the first and second jaws face towards one another. Such an orientation allows the respective jaw surfaces to hold an article there-between. However, the first jaw may also be secured to the slider such that the jaw surfaces face away from one another to allow the clamp to act as a spreading device.

The clamp's second jaw is preferably defined by the clamp's housing and is comprised of any number of rigid materials, to include metals, plastics, resin-based composite materials and other materials having rigid properties. The upper end of the second jaw defines a jaw surface preferably comprised of a compressible material. In a preferred embodiment of the invention, the second jaw and housing are unitary with one another. However, it is understood that the second jaw may be separate from, but connected to, the housing with any number of connection means contemplated by one of skill in the art.

Operably associated with the housing and slider is a first embodiment of the driving mechanism, a driving lever grip. The driving lever grip comprises a driving lever defining a through opening and comprised of any number of wear-resistant, rigid materials, to include metals, plastics, resin-based composite materials and other materials having wear-resistant, rigid properties. The through opening of the driving lever has the slider inserted there-through, with the driving lever movable between engaged and disengaged positions about the slider.

The through opening of the driving lever grips the slider when in the engaged position and releases the slider when in the disengaged position. In gripping the slider, upper and lower internal surfaces of the driving lever's through opening frictionally contact the respective upper and lower surfaces of the slider when the driving lever is pivoted by a predetermined angle in relation to the slider. When the driving lever is pivoted in an opposite direction in relation to the slider by about the same angle, the frictional contact between the respective upper and lower surfaces of the driving lever's opening and slider is reduced or removed, thereby releasing the slider in relation to the driving lever.

The driving lever is biased to the disengaged position and moved to the engaged position by a trigger pivotally related to the clamp housing. The trigger is movable between depressed and released positions such that the driving lever engages and drives the slider when the trigger is in the depressed position and releases the slider when the trigger is in the released position. The trigger is comprised of any number of rigid materials, to include metals, plastics, resin-based composite materials and other materials having rigid properties. In a preferred embodiment of the invention, the trigger is comprised of plastic. A compression spring, located between the driving lever and housing, both secures the driving lever against the trigger's rearward side and biases the trigger to the released position.

The clamping mechanism preferably comprises a clamping wedge grip. In one embodiment, the clamping wedge grip of the clamping mechanism comprises a clamping wedge block and a clamping pin actuator slidingly movable about the clamping wedge block. In other embodiments of the clamping wedge grip, respective clamping cam and clamping ball actuators are slidingly movable about the clamping wedge block. A compression spring is located between the housing and rearward end of the respective clamping actuators such that each actuator is spring-biased in a forward direction.

The clamping wedge block and the pin actuator have a pair of pins operably associated therewith for selective engagement between the clamping wedge block, pin actuator and slider. Similarly, the clamping wedge block and the cam actuator have a pair of cams operably associated therewith for selective engagement between the clamping wedge block, cam actuator and slider while the clamping wedge block and the ball actuator have a pair of balls operably associated therewith for selective engagement between the clamping wedge block, ball actuator and slider. Thus, a forward movement of the slider, along with force from the compression spring against the clamping actuator, will draw or move the pins, cams or balls against the slider to prevent any forward movement of the slider (i.e., to brake the slider). To release the slider and allow it to move in a forward direction again, the actuator is slidingly moved in a rearward direction to draw or move the pins, cams or balls away from the slider. However, because the actuator compression spring biases the actuator in a forwardly direction to force the pins, cams or balls against the slider, the clamping wedge grip is biased to brake and hold the slider for selective release.

A release mechanism is operably associated with the clamping mechanism and slider to release the slider. The release mechanism preferably comprises a release lever defining a through opening having the slider inserted there-through. The upper end of the release lever is pivotally related to the clamp's housing to enable the release lever to move between forward (disengaged) and rearward (engaged) positions in relation to the clamping actuator. A compression spring, located between a rearward side of the release lever and a forward side of the housing, biases the release lever to the forward (disengaged) position.

The rearward side of the release lever is located proximal to the wedge grip's actuator. Thus, when the release lever is moved from the forward (disengaged) to the rearward (engaged) position, the rearward side of the release lever contacts (engages) the actuator to disengage the clamping wedge grip from the slider. A release of the release lever by a user of the clamp will enable the compression spring to again move the release lever to the forward (disengaged) position, thus allowing the clamping wedge grip to again engage the slider. While the clamp utilizes a release lever as the preferred embodiment of the release mechanism, it is understood that other release mechanisms may be utilized as well. For example, the clamping actuator may include a slide button, handle or trigger extending therefrom to allow the actuator to be drawn in a rearward direction to release slider from the wedge grip.

In an alternative embodiment, the driving mechanism comprises a driving wedge grip. In one embodiment, the driving wedge grip comprises a driving wedge block, slidingly related to the housing, and a driving pin actuator. A pair of driving pins is operably associated with the driving wedge block, pin actuator and slider. In other embodiments, the driving wedge grip comprises a driving wedge block, slidingly related to the housing, and driving cam and driving ball actuators, respectively. In these respective alternate embodiments, a pair of driving cams or balls is operably associated with the driving wedge block, actuator and slider.

Thus, a rearward movement of the wedge block, along with the preload force on the actuator (provided by the compression spring located between the wedge block forward end and the actuator), will draw or move the respective pins, cams or balls against the slider to allow them to grip and hold the slider as the wedge block moves in a rearward direction. The pins, cams or balls of the driving grip thus grip the slider when the driving wedge block is moved in a rearward direction and release the slider when the wedge block is moved in a forward direction.

The driving wedge block is biased to the forward direction by a compression spring located between the wedge block and the housing, and moved in the rearward direction by a trigger pivotally related to the clamp housing. The trigger is movable between depressed and released positions such that the pins, cams or balls of the driving grip engage and drive the slider when the trigger is in the depressed position and release the slider when the trigger is in the released position. The trigger is comprised of any number of rigid materials, to include metals, plastics, resin-based composite materials and other materials having rigid properties.

In use, the clamp is operable between engaged, released and driving positions. When in the engaged position, the clamp is typically gripping an article between the clamp's jaws while the drive mechanism is not actuated. To release the clamp, the release lever of the release mechanism is pivoted in a rearward direction until it contacts the clamping mechanism's pin, cam or ball actuator. The release lever is then further pivoted in a rearward direction to slide the actuator in a rearward direction, thus drawing or moving the pins, cams or balls in a rearward direction and out of frictional contact from slider. The slide bar can now be moved freely in the forward and rearward direction. Upon a release of the release lever, the actuator compression spring thereafter moves the actuator in a forward direction, to engage the pins, cams or balls to again prevent the slider from moving in a forward direction, while the release lever compression spring moves the release lever in a forward direction again.

To drive the jaws of the device in embodiments of the clamp utilizing the driving lever grip as the driving mechanism, the trigger is pivoted in a rearward direction to move the upper and lower inner surfaces of the driving lever's through opening into frictional contact with the upper and lower surfaces of the slider. The trigger is then further pivoted in a rearward direction to drive the slider in a rearward direction, thus drawing the first jaw of the clamp towards the second jaw. The trigger compression spring thereafter moves the trigger in a forward direction. At this point, the pins, cams or balls of the clamping mechanism will again engage the bar to prevent any forward movement of the bar.

To drive the jaws of the device in embodiments of the clamp utilizing a driving wedge grip as the driving mechanism, the trigger is pivoted in a rearward direction to move the driving wedge block in a rearward direction to cause the pins, cams or balls to come into frictional contact with the slider. The trigger is then further pivoted in a rearward direction to drive the slider in a rearward direction, thus drawing the first jaw of the clamp towards the second jaw. Upon a release of the trigger by the user, the compression spring thereafter moves the driving wedge block and trigger in the forward direction. At this point, the pins, cams or balls of the clamping mechanism will again engage the bar to prevent any forward movement of the bar.

BRIEF DESCRIPTION OF THE DRAWINGS

FIG. 21A is an elevation view of the components of the clamp of FIG. 9 in the driving position; and.

DESCRIPTION OF THE EMBODIMENTS

Figure 1:
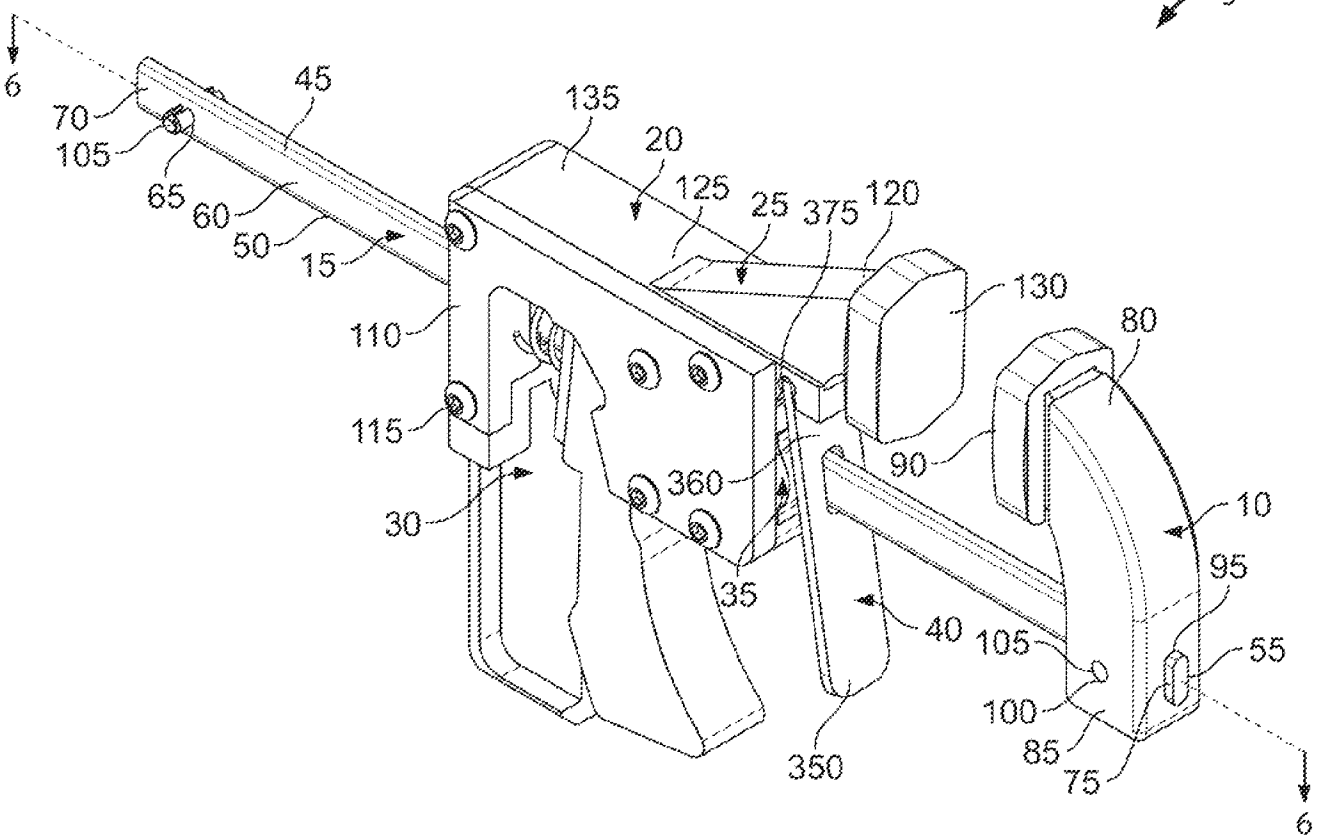
FIG. 1 is a perspective view of a first embodiment of the bar clamp having a first embodiment of a driving mechanism while FIG. 9 introduces a second embodiment of the driving mechanism.
Figure 9:
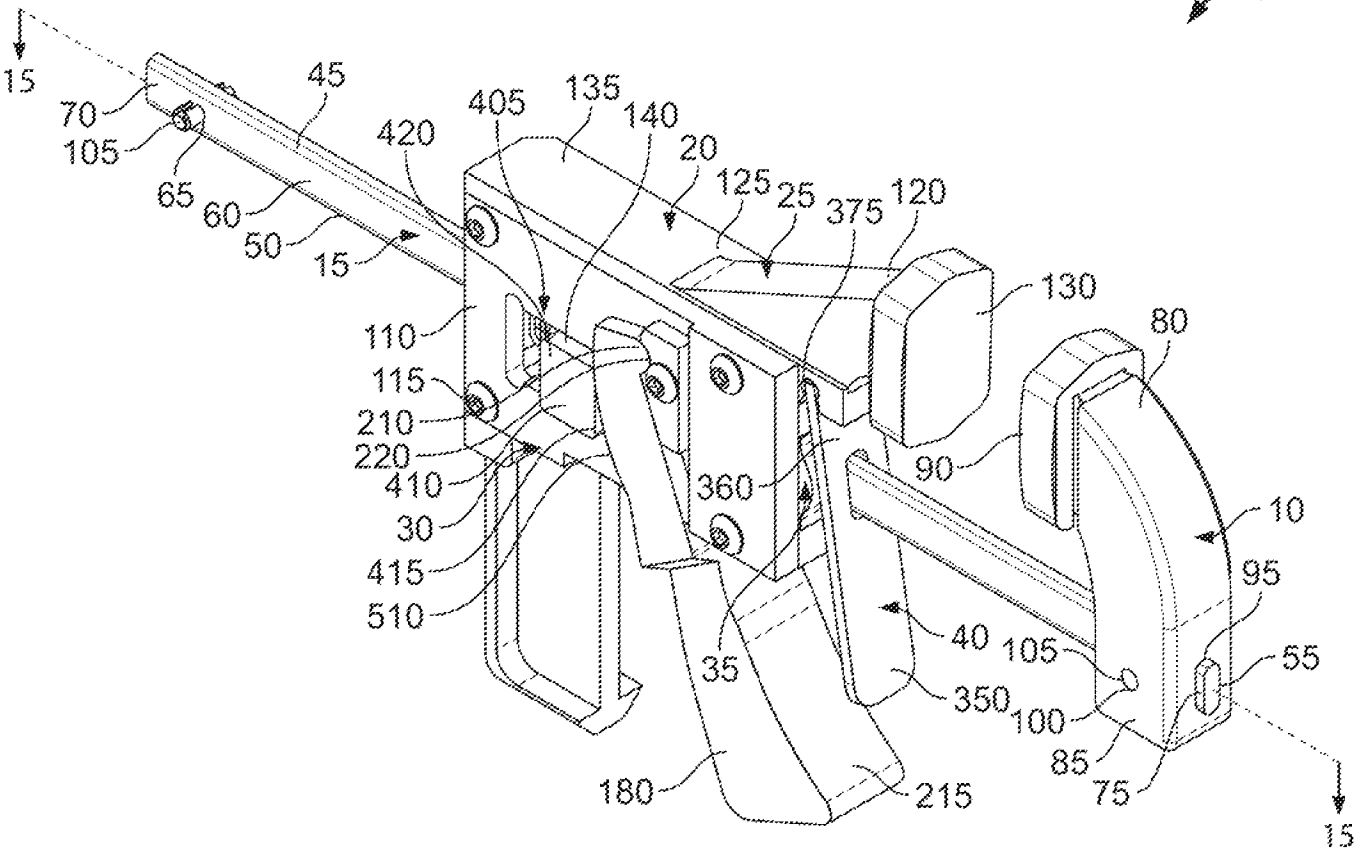
FIG. 9 is a perspective view of an embodiment of the bar clamp having a second embodiment of a driving mechanism, the clamping and release mechanisms unchanged from that of FIG. 1.

FIGS. 1 and 9 illustrate the basic components of two respective embodiments of the bar clamp. It is noted that the embodiments of FIGS. 1 and 9 utilize respectively different embodiments of a drive mechanism while preferably utilizing common clamping and release mechanisms (all mechanisms to be further discussed). As illustrated therein, the bar clamp 5 of FIGS. 1 and 9 comprises a first jaw 10 connected to a slider 15, a clamp housing 20 defining a second jaw 25, a driving mechanism 30 operably associated with the housing and slider to drive the slider, a clamping mechanism 35 operably associated with the housing and slider to brake and hold the slider, and a release mechanism 40 operably associated with the clamping mechanism and slider to release the slider.

The slider 15 of FIGS. 1 and 9 is preferably a straight piece of elongated material that adjustably connects the first and second jaws 10 and 25 of the clamp to one another. The slider preferably defines a substantially rectangular cross section, having upper and lower edge surfaces 45 and 50 and first and second side surfaces 55 and 60, that is preferably oriented vertically in relation to the clamp. It is understood, however, that the slider may define other cross sections as well, to include square, circular, ovular, triangular, trapezoidal and other cross sections contemplated by those of skill in the art. The slider is comprised of any number of rigid materials, to include metals, plastics, resin-based composite materials and other materials having rigid properties. In a preferred embodiment of the invention, the slider is comprised of steel. A through slider bore 65 is defined proximal to rearward and forward ends 70 and 75 of the slider to facilitate attachment of the clamp's first jaw 10 thereto.

The clamp's first jaw 10 of FIGS. 1 and 9 preferably comprises a structure having upper and lower ends 80 and 85. The first jaw is comprised of any number of rigid materials, to include metals, plastics, resin-based composite materials and other materials having rigid properties. In a preferred embodiment of the invention, the first jaw is comprised of plastic. The upper end of the jaw defines a jaw surface 90, preferably comprised of compressible material, while the lower end of the jaw defines a slider bore 95 and a pin bore 100 there-through. The slider bore and pin bore define respective axes that intersect one another at a 90 degree angle, with the slider bore axis oriented parallel to the slider 15 and the pin bore axis oriented perpendicular to the slider.

The forward end 75 of the slider is thus inserted into the slider bore of the first jaw 10 until the bore of the slider axially aligns with the pin bore of the jaw. A pin 105 is inserted into both the bore 95 of the slider 15 and the pin bore 100 of the first jaw 10 to secure the jaw to the slider. It is noted that the first jaw is typically secured to a forward end 75 of the slider such that the jaw surfaces of the first and second jaws face towards one another. Such an orientation, of course, allows the respective jaw surfaces to hold an article there-between. However, the first jaw 10 may also be secured to the rearward end 70 of the slider such that the jaw surfaces face away from one another. This orientation allows the respective jaw surfaces to hold articles away from one another, thus allowing the clamp to act as a spreading device.

The clamp's second jaw 25 of FIGS. 1 and 9 is preferably defined by the clamp's housing 20. The housing also defines a cover 110, attached thereto by screws 115, that allows access to the components of the drive mechanism 30 and/or clamping mechanism 35 located therein (to be further discussed). The second jaw, housing and cover are comprised of any number of rigid materials, to include metals, plastics, resin-based composite materials and other materials having rigid properties. In a preferred embodiment of the invention, the second jaw, housing and cover are comprised of plastic. Like the first jaw 10, the clamp's second jaw 25 comprises a structure having upper and lower ends 120 and 125. The upper end of the second jaw defines a jaw surface 130, preferably comprised of a compressible material, while the lower end of the jaw defines a body 135 of the housing. In a preferred embodiment of the invention, the second jaw 25 and body 135 of the housing 20 are unitary with one another. However, it is understood that the second jaw may be separate from, but connected to, the housing's body with any number of connection means contemplated by one of skill in the art.

Figure 2:
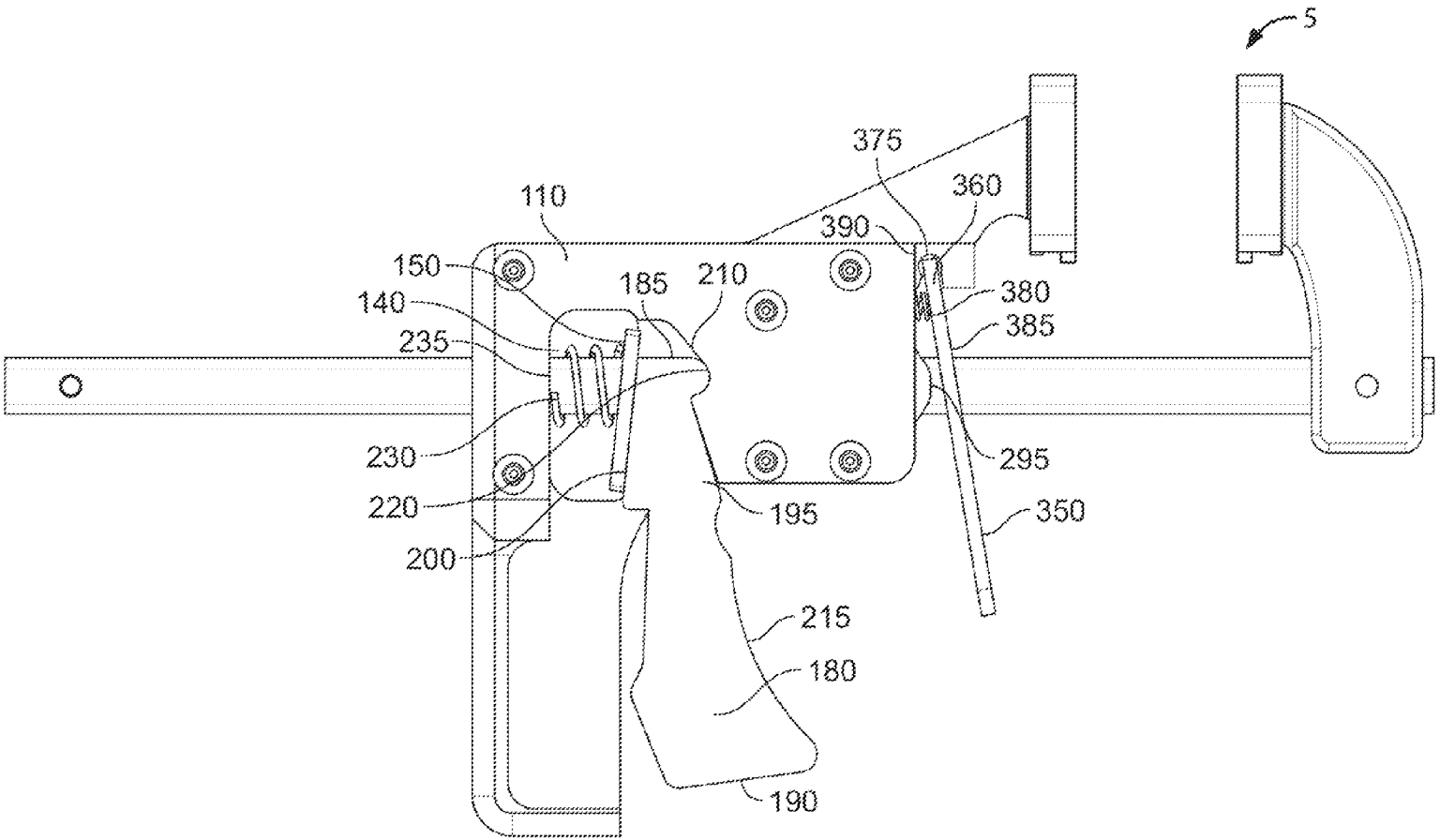
FIG. 2 is an elevation view of the clamp of FIG. 1.
Figure 3:
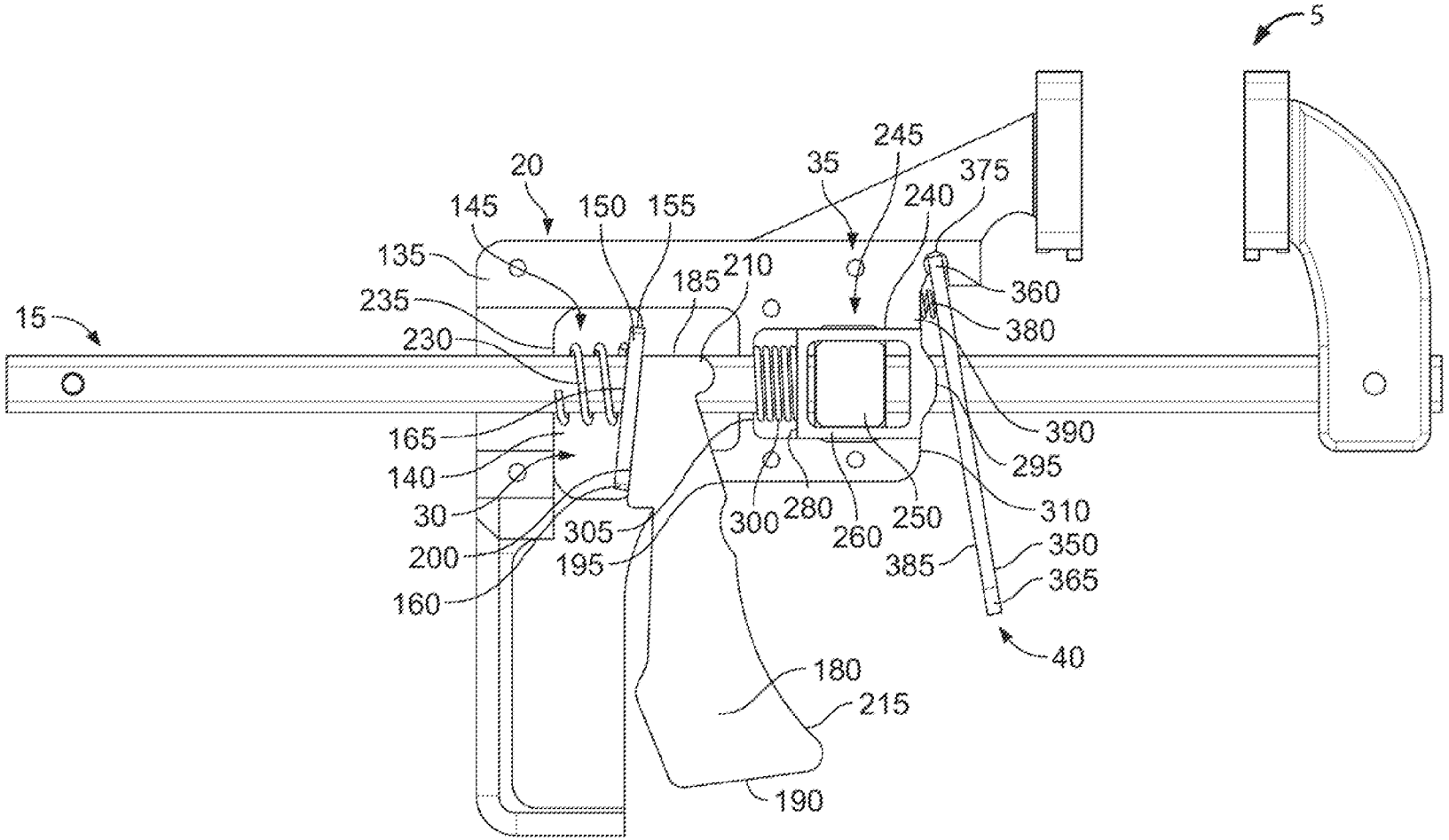
FIG. 3 is an elevation view of the clamp of FIG. 1 having the cover of the housing removed.
Figure 4:
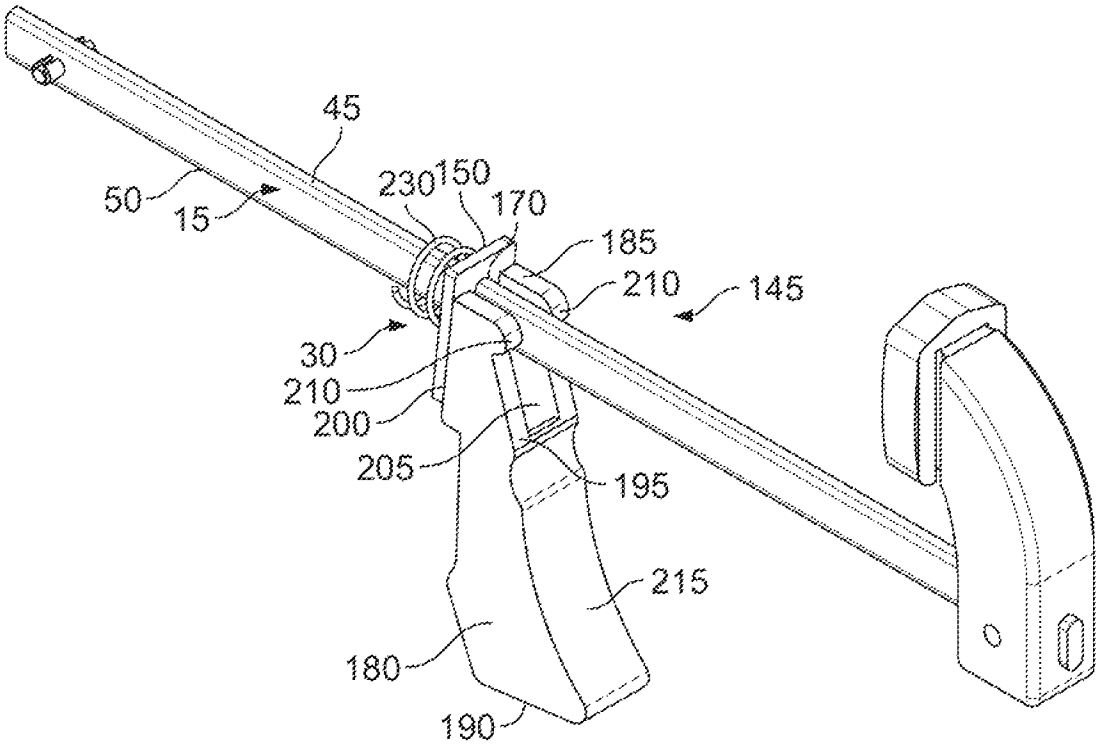
FIG. 4 is a perspective view of the first embodiment of the driving mechanism of the clamp of FIG. 1.
Figure 5:
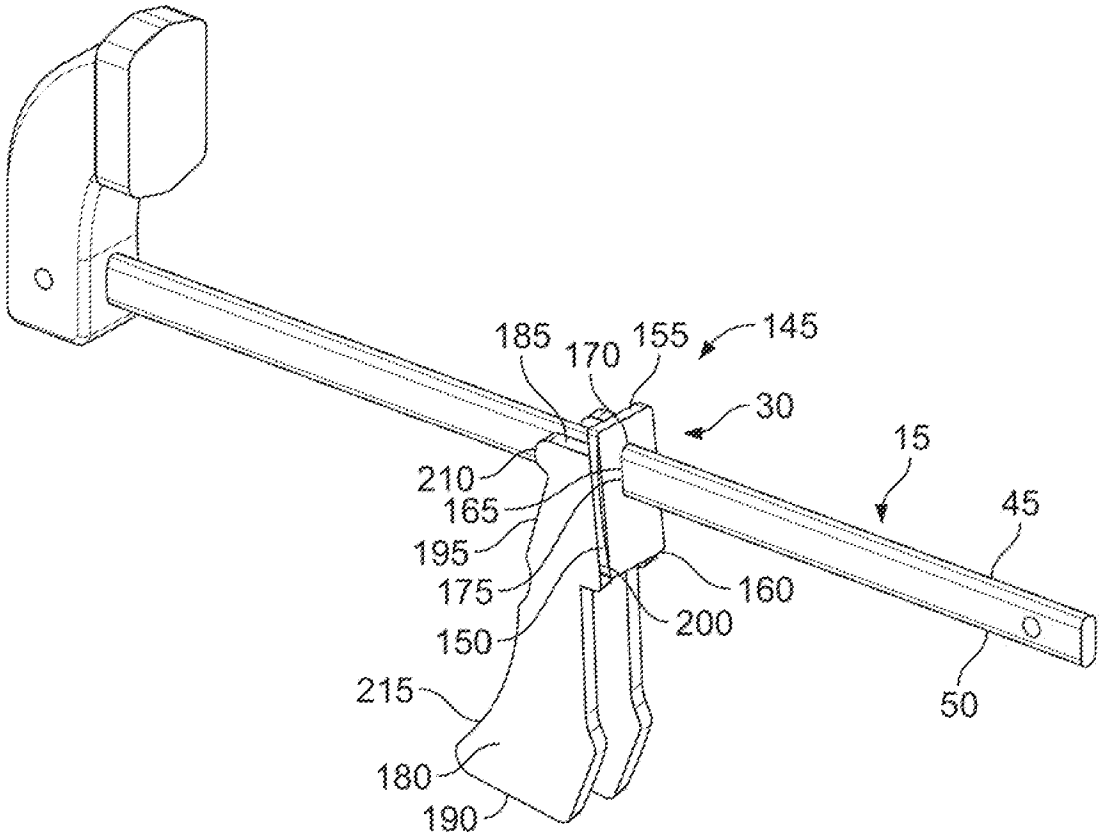
FIG. 5 is a perspective view of the driving mechanism of FIG. 4, as viewed from an opposing direction and having the driving lever compression spring removed for clarity.
Figure 6:
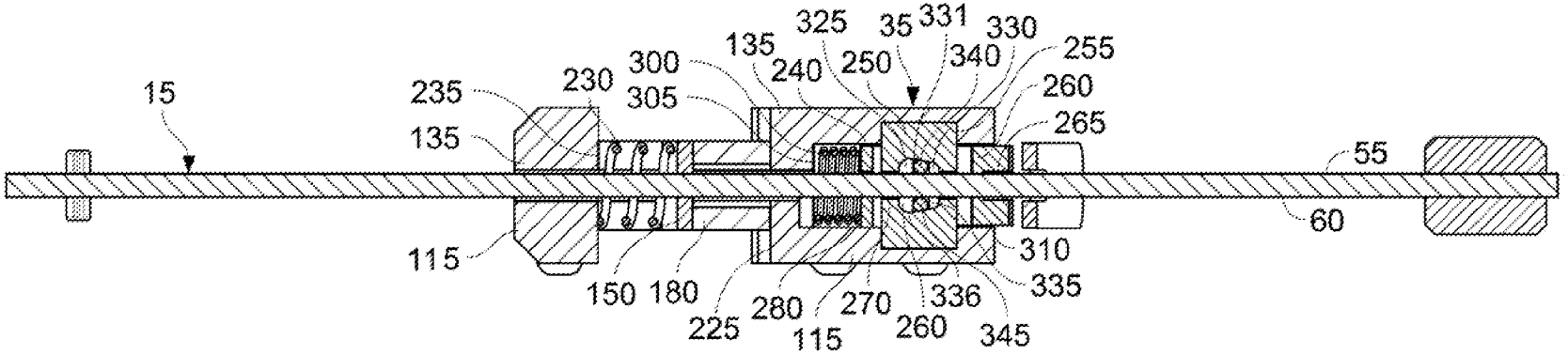
FIG. 6 is a sectional view of FIG. 1.

FIGS. 2 and 3 further illustrate the clamp embodiment of FIG. 1, (FIG. 3 illustrating the cover 110 and screws 115 of the housing 20 removed for clarity), while FIGS. 4, 5 and 6 illustrate the components of the driving mechanism 30 in of FIGS. 1-3 in further detail. Operably associated with the housing 20 and slider 15 is a first embodiment of the driving mechanism 30. As best illustrated in FIG. 3, the driving mechanism 30, preferably located within a driving cavity 140 defined in the housing's body 135, comprises a driving lever grip 145. The driving lever grip comprises a driving lever 150 having upper and lower ends 155 and 160 and defining a through opening 165 there-between (FIG. 5). The driving lever is comprised of any number of wear-resistant, rigid materials, to include metals, plastics, resin-based composite materials and other materials having wear-resistant, rigid properties. In a preferred embodiment of the invention, the driving lever is comprised of steel. The through opening 165 of the driving lever has the slider 15 inserted there-through, with the driving lever movable between engaged and disengaged positions about the slider.

The through opening 165 of the driving lever grips the slider 15 when in the engaged position and releases the slider when in the disengaged position. In gripping the slider 15, upper and lower internal surfaces 170 and 175 (FIG. 4) of the driving lever's through opening 165 frictionally contact the respective upper and lower surfaces 45 and 50 of the slider 15 when the driving lever is pivoted by a predetermined angle in relation to the slider. When the driving lever 150 is pivoted in an opposite direction in relation to the slider 15 by about the same angle, the frictional contact between the respective upper and lower surfaces of the driving lever's opening and slider is reduced or removed, thereby releasing the slider in relation to the driving lever. It is noted that the driving lever will have a greater angle, in relation to the slider, when in the engaged position than it does when in the disengaged position.

The driving lever 150 is biased to the disengaged position and moved to the engaged position by a trigger 180 pivotally related to the clamp housing 20. The trigger 180 is movable between depressed and released positions such that the driving lever 150 engages and drives the slider 15 when the trigger is in the depressed position and releases the slider when the trigger is in the released position. Defining upper and lower ends 185 and 190 and forward and rearward sides 195 and 200, the trigger is comprised of any number of rigid materials, to include metals, plastics, resin-based composite materials and other materials having rigid properties. In a preferred embodiment of the invention, the trigger is comprised of plastic.

A recess 205 (FIG. 4) extends downwardly from the trigger's upper end 185 to define a pair of arcuate pivot surfaces 210 extending from the forward side 195 of the trigger at the trigger's upper end. A grip surface 215 extends upwardly from the trigger's lower end 190 on the trigger's forward side as well. The pivot surfaces 210 of the trigger are configured for pivoting engagement with a pivot receiver 220 (FIG. 2), defined in the housing's body 135, and/or cover 110, while the grip surface 215 is configured to be gripped by the hand of a user of the clamp. The rearward side 200 of the trigger 180 is configured to receive the driving lever 150 at the trigger's upper end 185 such that the slider 15 extends through both the through driving lever's opening 165 (FIG. 5) and the trigger's recess 205 (FIG. 4).

When the trigger 180 is in the released position, the upper and lower internal surfaces 170 and 175 of the driving lever 150 may be disengaged from the respective upper and lower surfaces 45 and 50 of the slider 15 or in contact with the slider's surfaces but not having adequate friction to hold it in place. When the trigger is depressed, its pivot surfaces 210 pivot within the receiver 220 of the housing and cover (FIG. 2), thus causing the driving lever to pivot by the predetermined angle and grip the slider 15 via the frictional engagement between the respective upper and lower surfaces. When the trigger is further depressed, the pivot surfaces 210 further pivot within the receiver 220 of the housing and cover, thus causing the driving lever to grip and drive the slider in a rearward direction in relation to the housing. A compression spring 230, located between the driving lever 150 and a rearward wall 235 of the driving cavity 140, both secures the driving lever against the trigger's rearward side 200 and biases the trigger 180 to the released position.

Of course, if the first jaw 10 of the clamp is secured to the forward end 75 of the slider 15 such that the respective jaw surfaces of the first and second jaws face towards one another, the respective jaw surfaces will move towards one another (to grip an article there-between) as the trigger drives the slider in the rearward direction. Likewise, if the first jaw 10 of the clamp is secured to the rearward end 70 of the slider 15 such that the respective jaw surfaces of the first and second jaws face away from one another, the respective jaw surfaces will move away from one another (to function as a spreading device) as the trigger drives the slider in the rearward direction.

Referring again to FIGS. 3, 6 and 7, preferably located within a clamping cavity 240 defined within the housing's body 135 and cover 11, is the clamping mechanism 35. The clamping mechanism 35 preferably comprises a clamping wedge grip 245. In one embodiment, the clamping wedge grip of the clamping mechanism comprises a clamping wedge block 250, in securement with the housing's body 135 and cover 110 via a fitment into a clamping securement void 255 defined in the clamping cavity 240 of the housing's body 135 and cover 110, and a clamping pin actuator 260 slidingly movable within the clamping cavity about the clamping wedge block.

The clamping pin actuator and wedge block each define respective longitudinal through openings 265 and 270 (FIG. 6) through which the slider 15 extends. The clamping pin actuator 260 also defines a clamping wedge block opening 267 (FIG. 7), perpendicular to its through opening, to accommodate the clamping wedge block 250 within the pin actuator. Because the clamping pin actuator 260 is slidingly movable within the clamping cavity 240 of the housing and the clamping wedge block 250 is located substantially within the clamping pin actuator's wedge block opening 267, but secured to the housing via the securement void 255 (FIG. 6), the clamping pin actuator is thus able to slide back and forth within the clamping cavity about the clamping wedge block.

The clamping pin actuator 260 further defines forward and rearward ends 275 and 280 that protrude outwardly beyond respective forward and rearward ends 285 and 290 (FIG. 7) of the clamping wedge block 250, with the forward end of the clamping pin actuator 260 preferably defining a bull-nose contact surface 295. A compression spring 300 is located between a rearward wall 305 of the clamping cavity 240 and rearward end 280 of the clamping pin actuator 260 (FIGS. 3 and 6) such that the clamping pin actuator is spring-biased in a forward direction to cause the bull-nose contact surface 295 of the pin actuator to protrude outwardly from a forward opening 310 of the clamping cavity.

Figure 7:
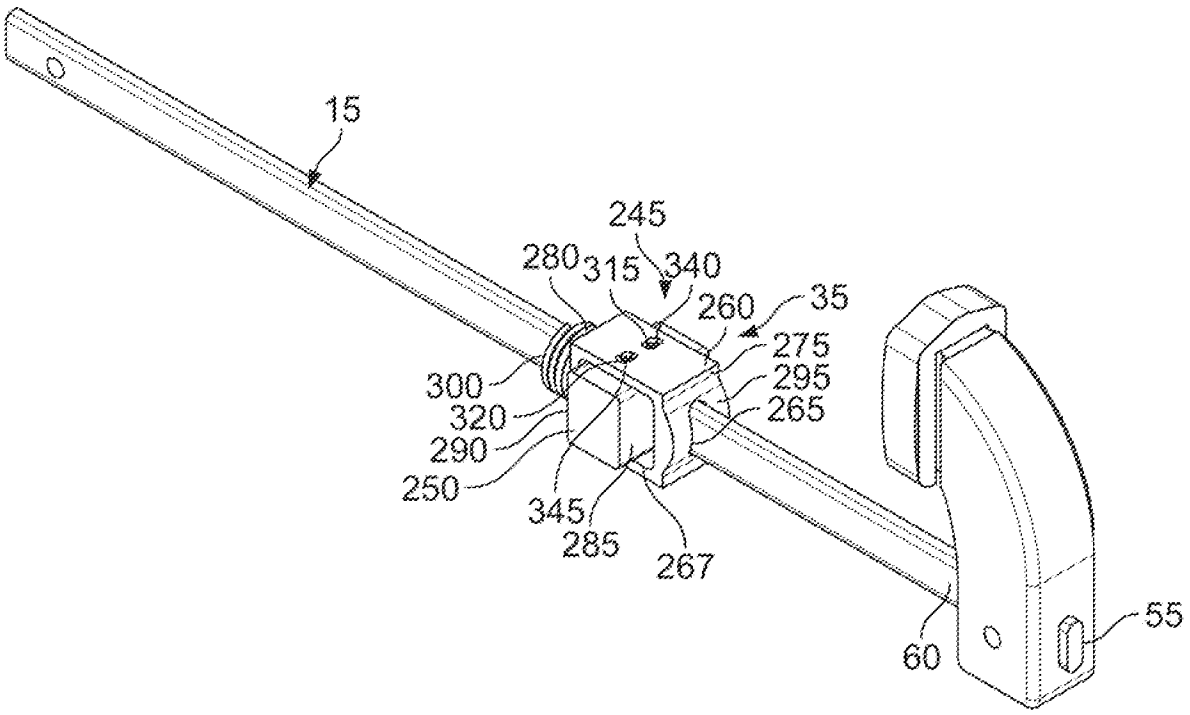
FIG. 7 is a perspective view of one embodiment of the clamping mechanism of the clamp of FIGS. 1 and 9.

As best illustrated in FIGS. 6 and 7, the pin actuator 260 further defines a pair of through pin slots 315 and 320 (FIG. 7) therein, located opposite of one another about the slider 15 and oriented perpendicular to the clamping pin actuator's through opening 265, while the clamping wedge block 250 preferably further defines a through trapezoidal opening 325 (FIG. 6) oriented perpendicular to the wedge block's through opening 270. With the wedge block 250 located about the slider 15, the wedge block's through trapezoidal opening 270 is bifurcated by the slider to define a pair of through wedge-shaped pockets 330 and 335 (FIG. 6) that are located opposite of one another about the slider 15. The pockets 330 and 335 define opposing angled walls 331 and 336 that toe in towards one another in a forward direction. The respective and opposite wedge-shaped pockets of the clamping wedge block and the slots of the pin actuator have respective pins 340 and 345 inserted there-though for selective engagement between the clamping wedge block, pin actuator and slider 15.

The angled walls 331 and 336 of the wedge-shaped pockets 330 and 335 taper towards the forward end 285 of the clamping wedge block 250 such that each pocket decreases in opening dimension from a size that exceeds the pin diameter to a size that is smaller than the pin diameter. Thus, with the slider 15 located between the pins 340 and 345, a forward movement of the slider, along with force from the compression spring 300 against the clamping pin actuator 260 to provide a preload, will draw the pins into the respective pockets 330 and 335 and against the angled walls 331 and 336, and also against the first and second side surfaces 55 and 60 (FIG. 6) of the slider, to prevent any forward movement of the slider (i.e., to brake the slider). To release the slider 15 and allow it to move in a forward direction again, the pin actuator 260 is slidingly moved in a rearward direction to draw the pins 340 and 345 out of the respective pockets 330 and 335, away from the angled walls 331 and 336 and away from the slider. However, because the pin actuator compression spring 300 biases the pin actuator 260 in a forwardly direction to force the pins into the wedge-shaped pockets against the slider, the clamping wedge grip 245 is biased to brake and hold the slider 15 for selective release.

Figure 8:
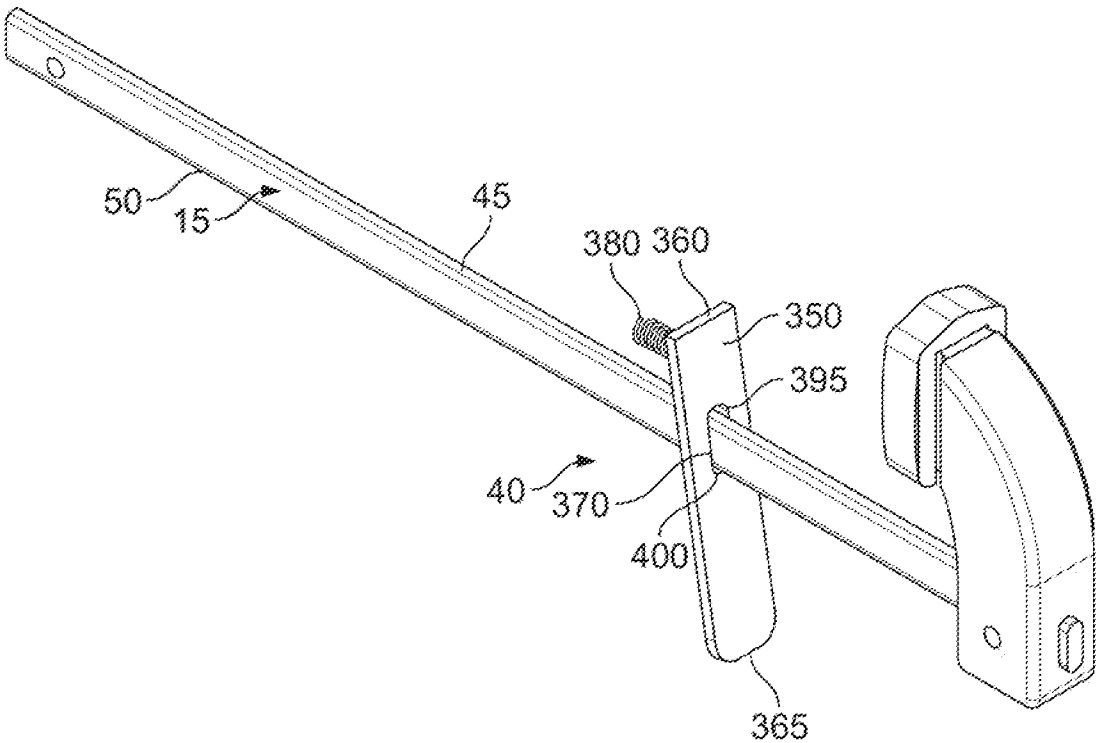
FIG. 8 is a perspective view of the release mechanism of the clamp of FIGS. 1 and 9.
Figure 8A:
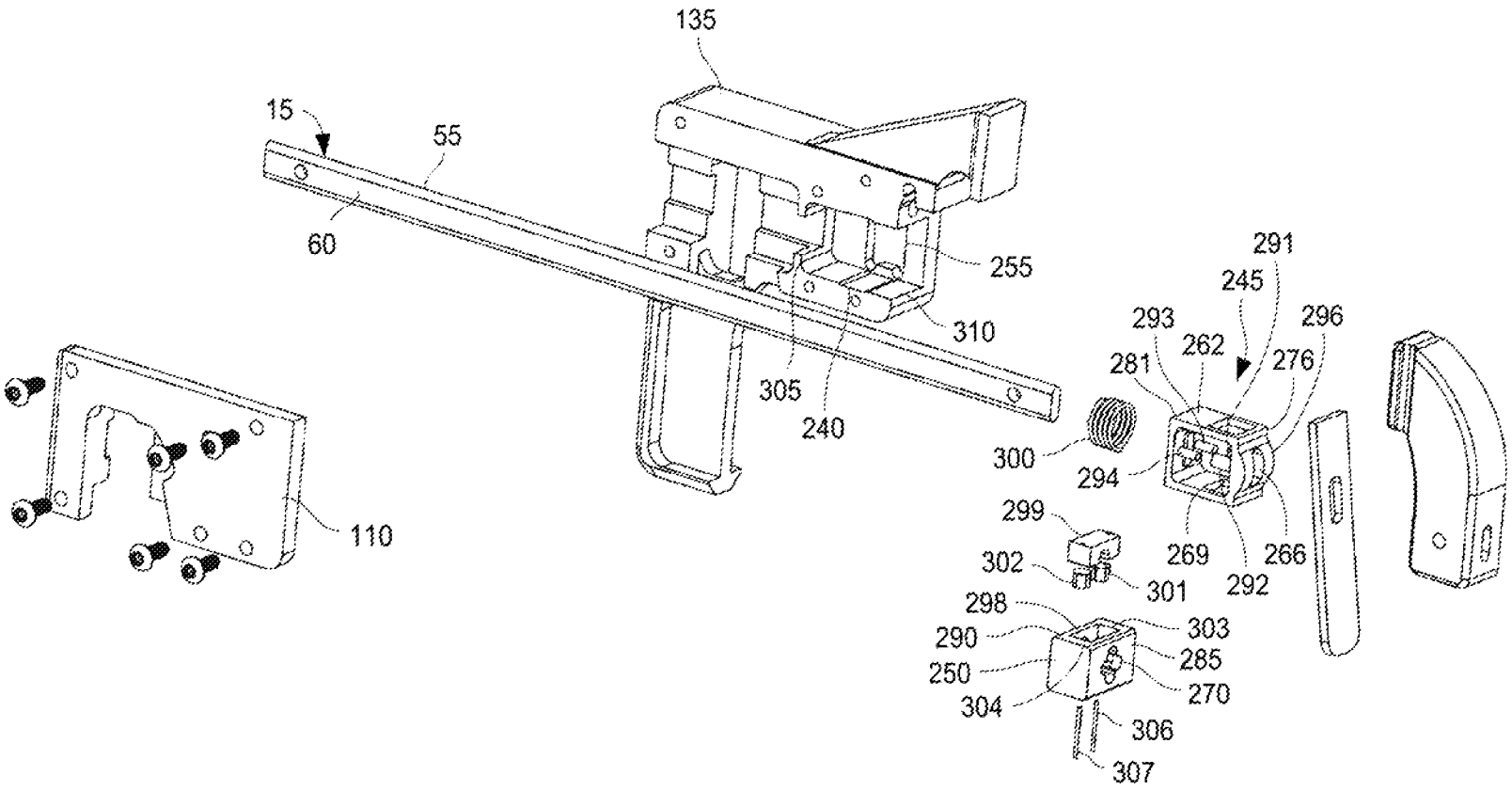
FIG. 8A is an assembly view of an alternate embodiment of the clamping wedge grip.

Referring to FIG. 8A, another embodiment of the clamping wedge grip 245 of the clamping mechanism comprises a clamping wedge block 250, in securement with the housing's body 135 and cover 110 via a fitment into a clamping securement void 255 defined in the clamping cavity 240 of the housing's body 135 and cover 110, and a clamping cam actuator 262 slidingly movable within the clamping cavity about the clamping wedge block.

The clamping cam actuator and wedge block each define respective longitudinal through openings 266 and 270 through which the slider 15 extends. The clamping cam actuator 262 also defines a clamping wedge block opening 269, perpendicular to its through opening, to accommodate the clamping wedge block 250 within the cam actuator. Because the clamping cam actuator 262 is slidingly movable within the clamping cavity 240 of the housing and the clamping wedge block 250 is located substantially within the clamping cam actuator's wedge block opening 269, but secured to the housing via the securement void 255, the clamping cam actuator is thus able to slide back and forth within the clamping cavity about the clamping wedge block.

The clamping cam actuator 262 further defines forward and rearward ends 276 and 281 that protrude outwardly beyond respective forward and rearward ends 285 and 290 of the clamping wedge block 250, with the forward end of the clamping cam actuator 262 preferably defining a bull-nose contact surface 296. A compression spring 300 is located between a rearward wall 305 of the clamping cavity 240 and rearward end 281 of the clamping cam actuator 262 such that the clamping cam actuator is spring-biased in a forward direction to cause the bull-nose contact surface 296 of the cam actuator to protrude outwardly from a forward opening 310 of the clamping cavity.

The cam actuator 262 further defines a pair of forward cam guides 291 and 292 and a pair of rearward cam guides 293 and 294 therein, with the guides of each pair located opposite of one another about the slider 15 and oriented parallel with the clamping cam actuator's through opening 266. The clamping wedge block 250 preferably further defines a cam housing opening 298 oriented perpendicular to the wedge block's through opening 270. The opening 298 of the wedge block is configured to accept the insertion of a cam housing 299 therein, for rotatably mounting a pair of cams 301 and 302 thereto, while the wedge block further defines opposing earn contact surfaces 303 and 304.

With the wedge block 250 located about the slider 15, the wedge block's cam housing opening 298 is bifurcated by the slider such that each cam of the pair of cams 301 and 302 and each cam contact surface of the opposing cam contact surfaces 303 and 304 is located opposite of one another about the slider 15. Each cam, located between the slider and respective contact surface, is thus configured for selective engagement between the slider and the respective contact surface of the clamping wedge block 250. Each cam is pivotally connected to the cam housing via respective posts 306 and 307 matingly connected to the housing.

The opposing cam contact surfaces 303 and 304 of the wedge block 250 are located a predetermined distance from the slider 15 such each cam will interferingly contact both the slider and a respective contact surface. Thus, with the slider 15 located between the cams 301 and 302, a forward movement of the slider, along with force from the compression spring 300 against the clamping cam actuator 262 to provide a preload to the cams via the rearward cam guides 293 and 294, will move the cams and against the opposing contact surfaces 303 and 304, and also against the first and second side surfaces 55 and 60 of the slider, to prevent any forward movement of the slider (i.e., to brake the slider). To release the slider 15 and allow it to move in a forward direction again, the cam actuator 262 is slidingly moved in a rearward direction to move the cams 301 and 302 away from the respective opposing contact surfaces 303 and 304 and away from the slider via the pair of forward cam guides 291 and 292. However, because the compression spring 300 biases the cam actuator 262 in a forwardly direction to force the cams against the slider via the rearward cam guides 293 and 294, the clamping wedge grip 245 is biased to brake and hold the slider 15 for selective release.

Figure 8B:
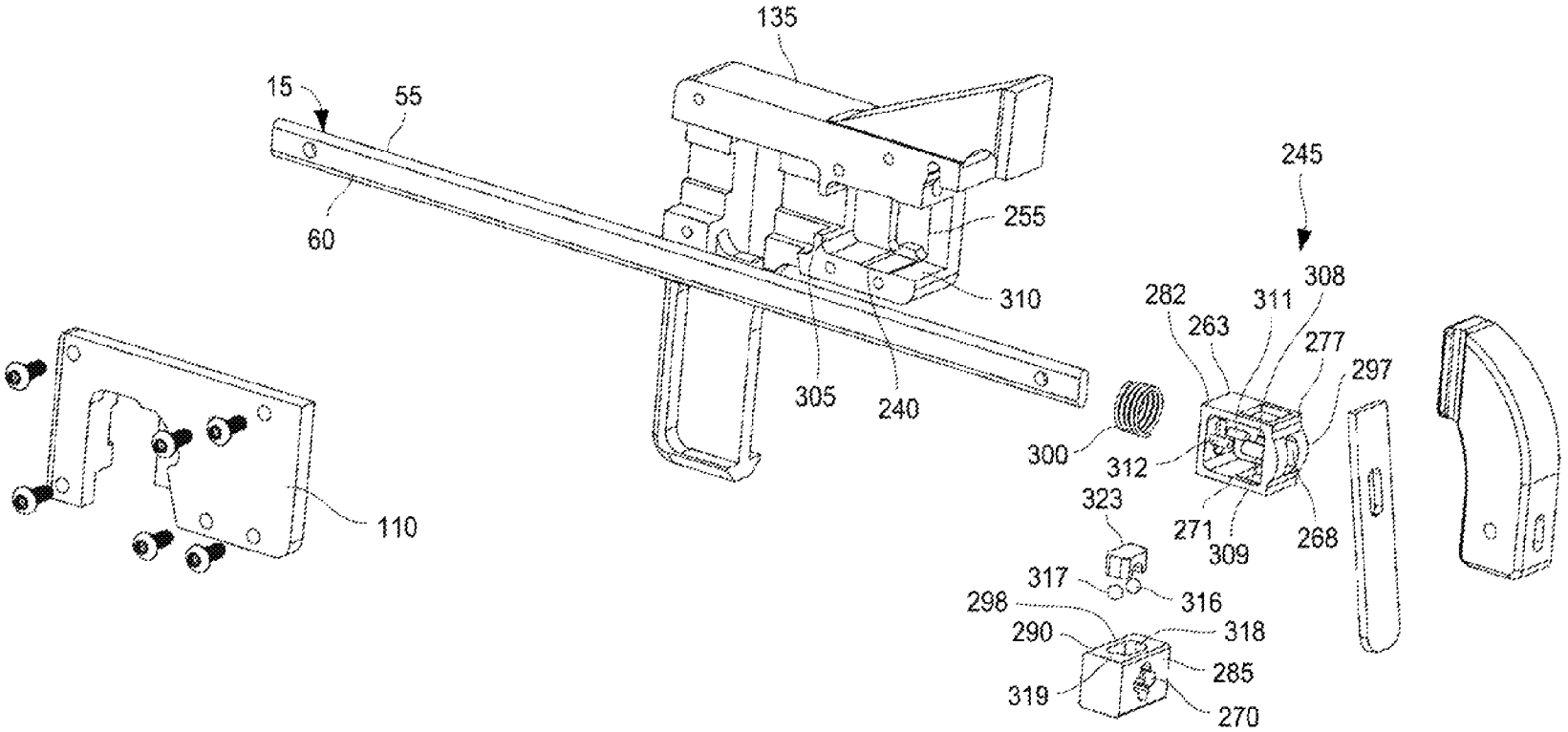
FIG. 8B is an assembly view of another alternate embodiment of the clamping wedge grip.

Referring to FIG. 8B, another embodiment of the clamping wedge grip 245 of the clamping mechanism comprises a clamping wedge block 250, in securement with the housing's body 135 and cover 110 via a fitment into a clamping securement void 255 defined in the clamping cavity 240 of the housing's body 135 and cover 110, and a clamping ball actuator 263 slidingly movable within the clamping cavity about the clamping wedge block.

The clamping ball actuator and wedge block each define respective longitudinal through openings 268 and 270 through which the slider 15 extends. The clamping ball actuator 263 also defines a clamping wedge block opening 271, perpendicular to its through opening, to accommodate the clamping wedge block 250 within the ball actuator. Because the clamping ball actuator 263 is slidingly movable within the clamping cavity 240 of the housing and the clamping wedge block 250 is located substantially within the clamping ball actuator's wedge block opening 271, but secured to the housing via the securement void 255, the clamping ball actuator is thus able to slide back and forth within the clamping cavity about the clamping wedge block.

The clamping ball actuator 263 further defines forward and rearward ends 277 and 282 that protrude outwardly beyond respective forward and rearward ends 285 and 290 of the clamping wedge block 250, with the forward end of the clamping ball actuator 263 preferably defining a bull-nose contact surface 297. A compression spring 300 is located between a rearward wall 305 of the clamping cavity 240 and rearward end 282 of the clamping ball actuator 263 such that the clamping ball actuator is spring-biased in a forward direction to cause the bull-nose contact surface 297 of the ball actuator to protrude outwardly from a forward opening 310 of the clamping cavity.

The ball actuator 263 further defines a pair of forward ball guides 308 and 309 and a pair of rearward ball guides 311 and 312 therein, with the guides of each pair located opposite of one another about the slider 15 and oriented parallel with the clamping ball actuator's through opening 268. The clamping wedge block 250 preferably further defines a ball housing opening 298 oriented perpendicular to the wedge block's through opening 271. The opening 298 is configured to accept the insertion of a ball housing 299 therein, for rotatably securing a pair of balls within the wedge block, while the wedge block further defines opposing angled contact surfaces 318 and 319 that toe in towards one another in a forward direction.

With the wedge block 250 located about the slider 15, the wedge block's ball housing opening 298 is bifurcated by the slider such that each ball of the pair of balls 316 and 317 and each ball angled contact surface of the opposing ball angled contact surfaces 318 and 319 is located opposite of one another about the slider 15. The angled walls 318 and 319 taper towards the forward end 285 of the clamping wedge block 250 such that respective pockets 321 and 322 are defined that decrease in opening dimension from a size that exceeds the ball diameter to a size that is smaller than the ball diameter.

Thus, with the slider 15 located between the balls 316 and 317, a forward movement of the slider, along with force from the compression spring 300 against the clamping ball actuator 263 to provide a preload via the rearward ball guides 311 and 312, will move the balls pins into the respective pockets 312 and 322 and against the angled contact surfaces 318 and 319, and also against the first and second side surfaces 55 and 60 of the slider, to prevent any forward movement of the slider (i.e., to brake the slider). To release the slider 15 and allow it to move in a forward direction again, the ball actuator 263 is slidingly moved in a rearward direction to draw the balls 316 and 317 out of the respective pockets 321 and 322, away from the angled contact surfaces 318 and 319 and away from the slider, all via the pair of forward ball guides 308 and 309. However, because the compression spring 300 biases the ball actuator 263 in a forwardly direction to force the balls against the slider via the rearward ball guides 311 and 312, the clamping wedge grip 245 is biased to brake and hold the slider 15 for selective release.

As previously discussed, the bar clamp 5 of FIGS. 1 and 9 includes a release mechanism 40 operably associated with the clamping mechanism 35 and slider 15 to release the slider. As illustrated therein, the release mechanism preferably comprises a release lever 350. Referring to FIG. 8, the release lever 350 defines upper and lower ends 360 and 365 and a through opening 370 between there-between; with the through opening having the slider 15 inserted there-through.

The upper end 360 of the release lever 350 is pivotally related to the clamp's housing 20, via a release lever pivot recess 375 (FIGS. 2 and 10), to enable the release lever to move between forward (disengaged) and rearward (engaged) positions in relation to the bull-nose 295 of the clamping pin actuator 260. A compression spring 380, located between a rearward side 385 of the release lever 350 and a forward side 390 of the housing, biases the release lever to the forward (disengaged) position. The rearward side 385 of the release lever 350 is located proximal to the bull-nose contact surface 295 of the wedge grip's pin actuator 260. Thus, when the release lever 350 is moved from the forward (disengaged) to the rearward (engaged) position, the rearward side 385 of the release lever contacts (engages) the bull-nose contact surface 295 of the pin actuator 260 (or of the cam or ball actuators of other embodiments) to disengage the clamping wedge grip 245 from the slider 15. A release of the release lever by a user of the clamp will enable the compression spring 380 to again move the release lever to the forward (disengaged) position, thus allowing the clamping wedge grip to again engage the slider.

It is noted that the release lever's opening 370 may optionally have a dimension that enables the upper and lower inner surfaces 395 and 400 (FIG. 8) to frictionally contact the slider's respective upper and lower surfaces 45 and 50 when the lever is in the forward position. Such a frictional contact thus would, in addition to the clamping mechanism, further prevent the slider from moving in a forward direction. It is further noted, however, that while clamp 5 utilizes a release lever as the preferred embodiment of the release mechanism, it is understood that other release mechanisms may be utilized as well. For example, the clamping pin actuator 260 may include a slide button, handle or trigger extending therefrom to allow the pin actuator to be drawn in a rearward direction to release slider from the wedge grip.

Figure 10:
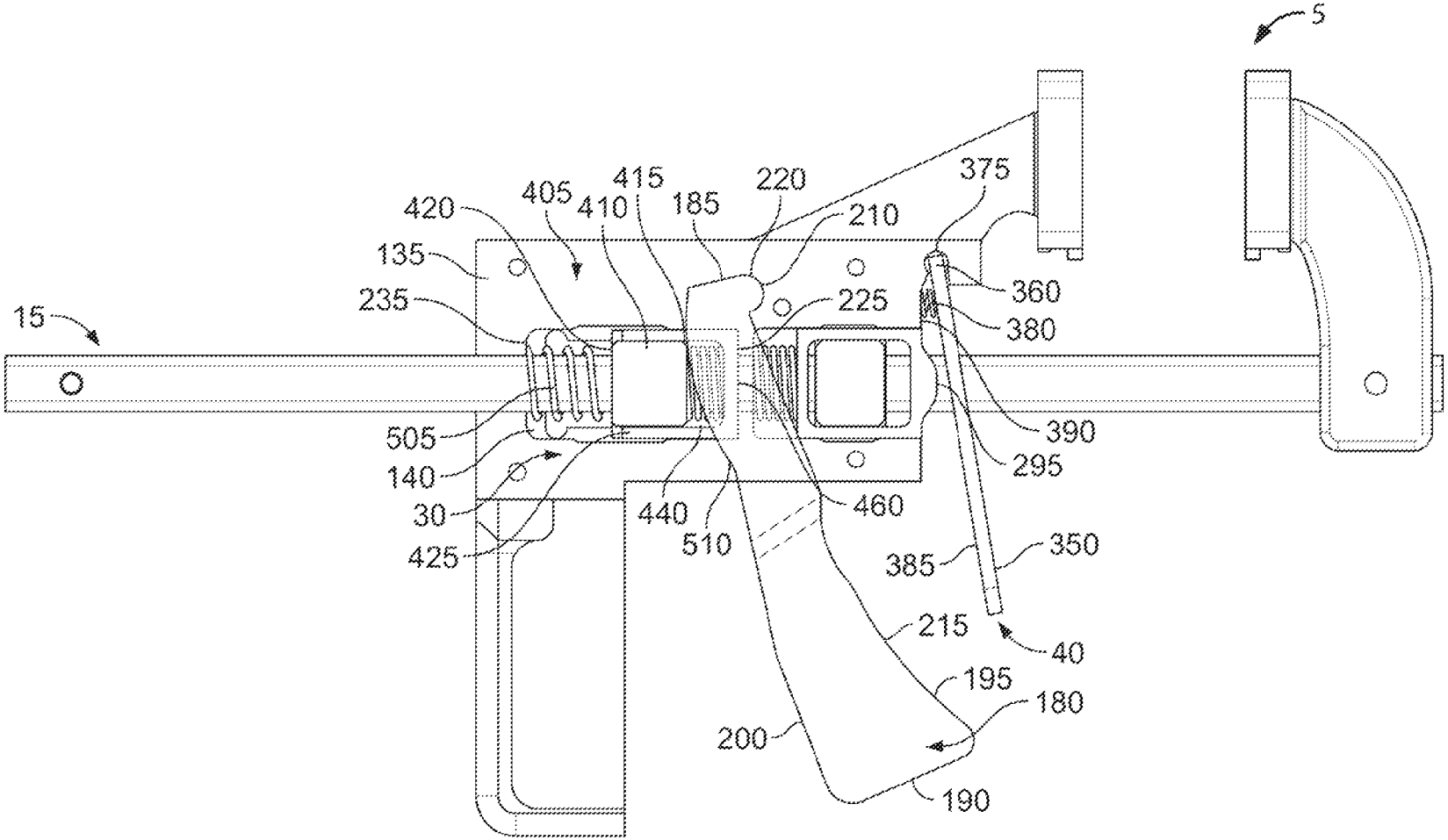
FIG. 10 is an elevation view of the clamp of FIG. 9 having the cover of the housing removed and illustrating the trigger in phantom.

As introduced earlier herein, FIG. 9 illustrates a clamp utilizing an alternative embodiment of the driving mechanism 30, the clamp of this embodiment having the clamping and release components unchanged from that of FIG. 1. FIG. 10 illustrates the clamp embodiment of FIG. 9 with the cover 110 and screws 115 of the housing 20 removed, while FIGS. 11-15 illustrate the components of the driving mechanism 30 of FIGS. 9 and 10 in further detail. The driving mechanism 30 of this embodiment of the clamp, again located with the driving cavity 140 defined in the housing's body 135, comprises a driving wedge grip 405. The driving wedge grip of the driving mechanism comprises a driving wedge block 410, defining forward and rearward ends 415 and 420 (FIG. 10) and slidingly related to the housing's body 135 and cover 110 within the driving cavity 140, and in one embodiment, a driving pin actuator 425. Other embodiments of the driving wedge grip utilize a driving cam actuator or a driving ball actuator, to be further discussed.

Thus, in one embodiment, the driving pin actuator 425 and wedge block 410 each define respective longitudinal through openings 430 (FIGS. 11 and 12) and 435 (FIG. 13) through which the slider 15 extends. The driving pin actuator 425 also defines a driving wedge block recess 440 (FIGS. 12 and 14), perpendicular to the through opening, to accommodate the driving wedge block 410 therein. With the driving wedge block 410 located substantially within the driving pin actuator's wedge block recess 440, the driving wedge block is thus able to slide back and forth within recess of the pin actuator. The driving pin actuator 425 further defines forward and rearward ends 445 and 450 (FIGS. 11 and 12), with the forward end 445 protruding outwardly beyond the forward end 415 of the driving wedge block 410 and preferably defining inner and outer forward contact surfaces 455 and 460.

The rearward end 450 of the driving pin actuator is adapted to engage an inward stop surface 422 (FIGS. 13 and 14) defined at the rearward end of the driving wedge block. A compression spring 465 (FIG. 12) is located between the forward inner contact surface 455 of the driving pin actuator's forward end 445 and the forward end 415 of the driving wedge block 410 such that the driving pin actuator is spring-biased in a forward position in relation to the driving wedge block to provide a pre-load force, to be discussed further. A forward movement of the driving pin actuator in relation to the driving cavity 140 is prevented by the forward wall 225 of the driving cavity (FIG. 10), which abuts the forward outer contact surface 460 of the driving pin actuator.

Figure 11:
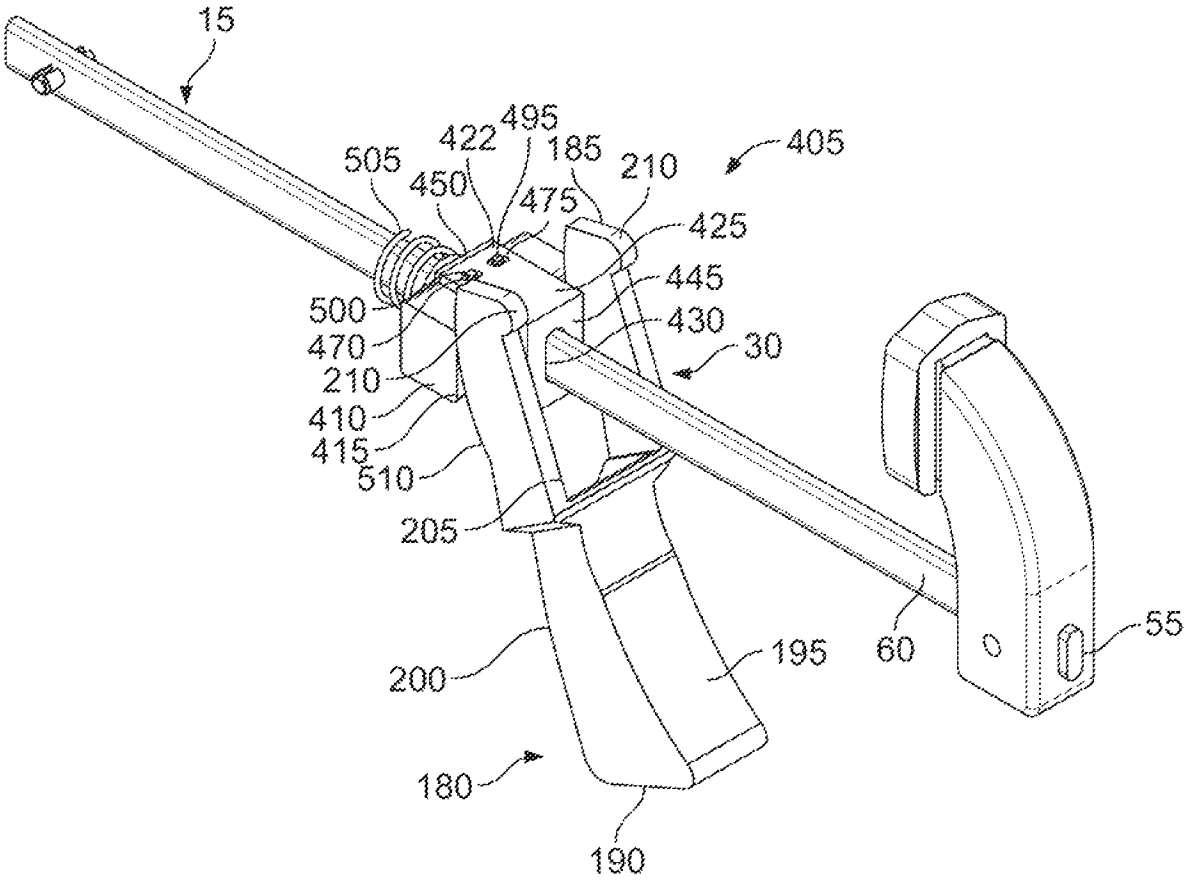
FIG. 11 is a perspective view of one embodiment of the driving mechanism of the clamp of FIG. 9.
Figure 12:
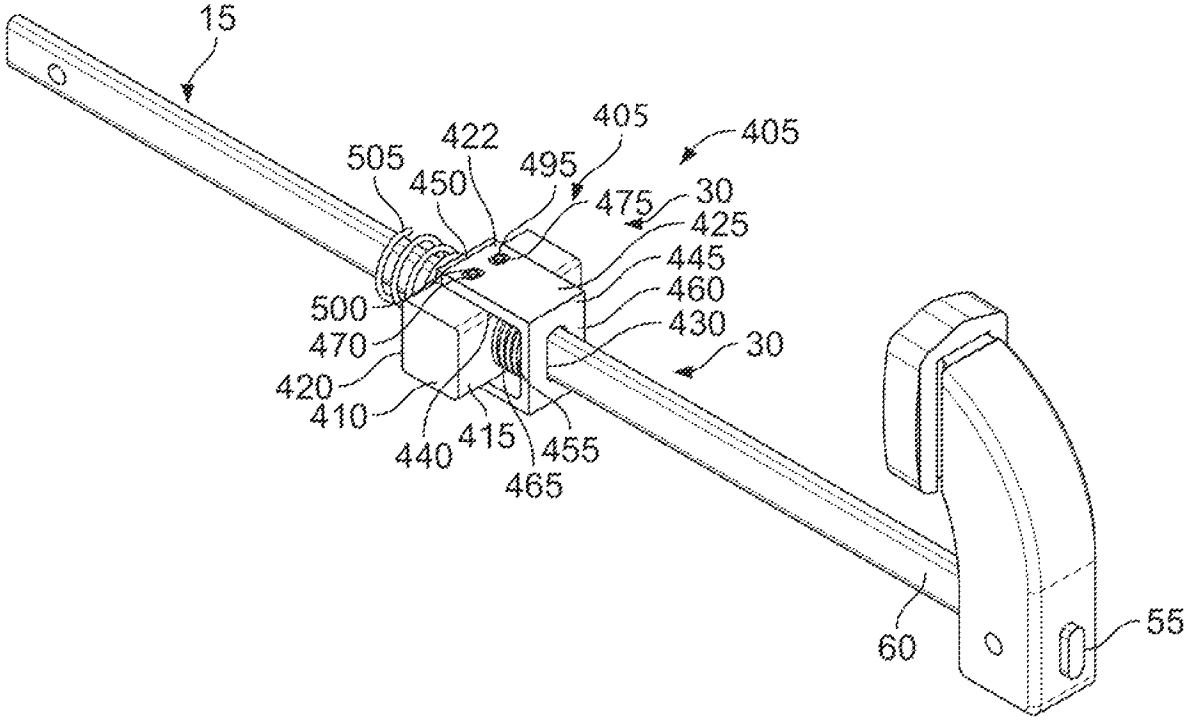
FIG. 12 is a perspective view of the driving mechanism of FIG. 11 and having the trigger removed for clarity.
Figure 13:
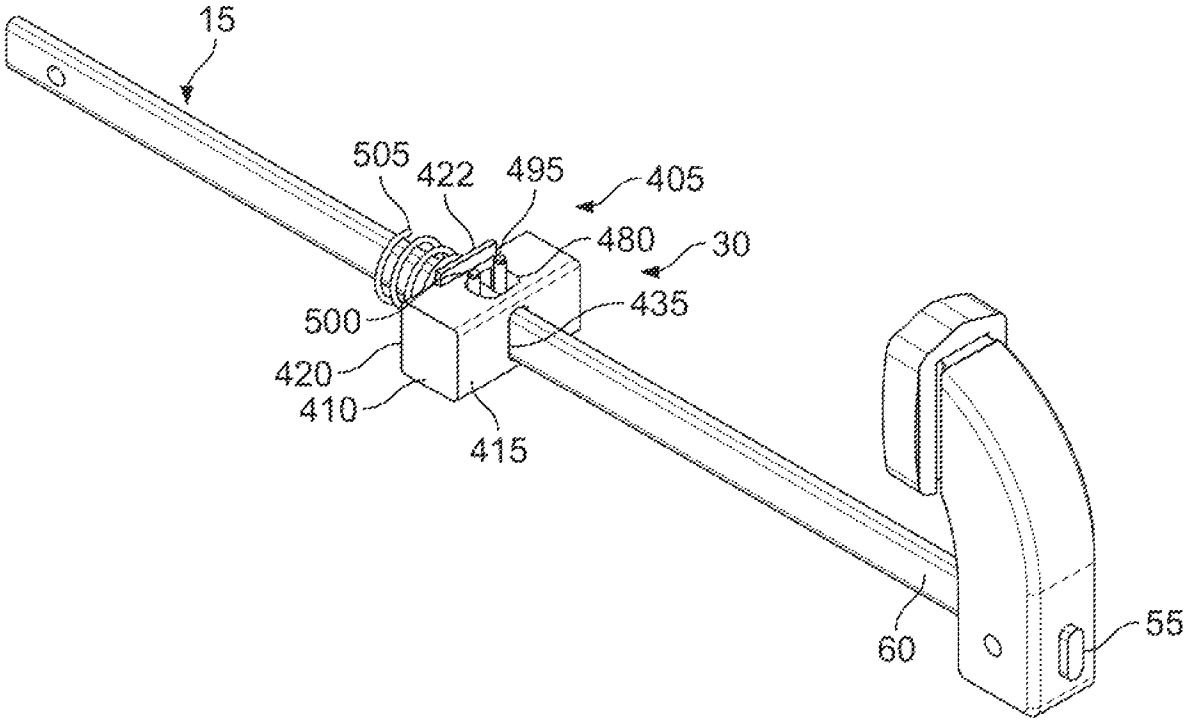
FIG. 13 is a perspective view of the driving mechanism of FIG. 11 and having the trigger, driving pin actuator and driving pin actuator compression spring removed for clarity.
Figure 14:
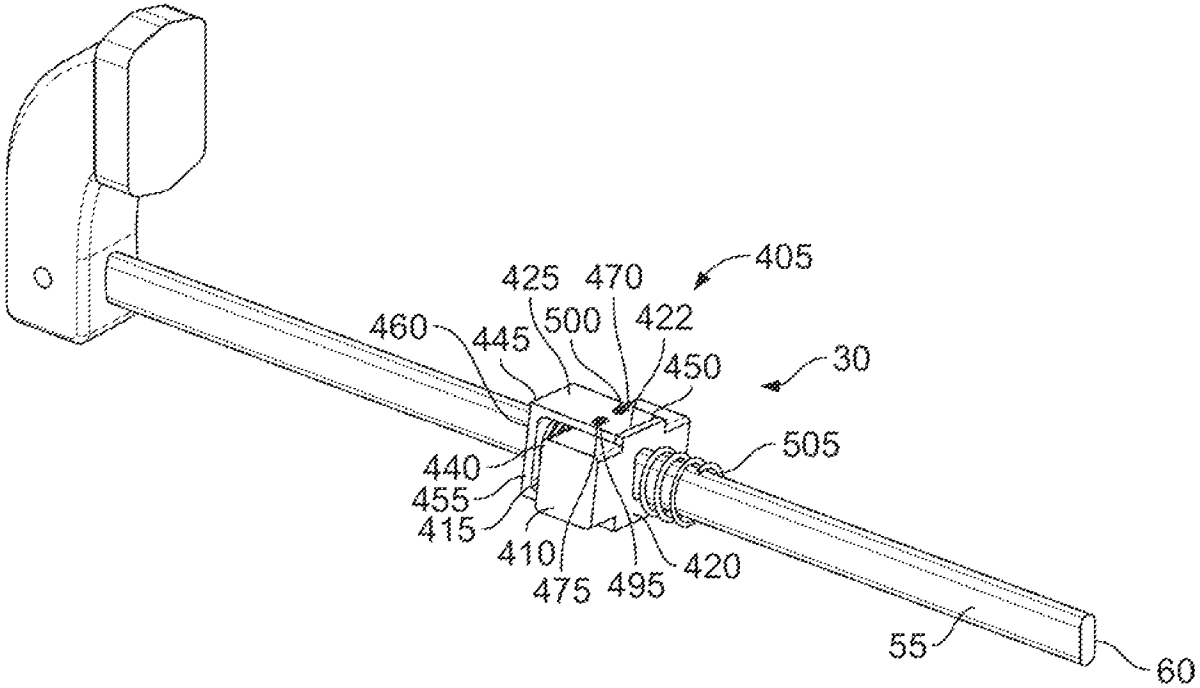
FIG. 14 is a perspective view of the driving mechanism of FIG. 12, as viewed from an opposing direction.
Figure 15:
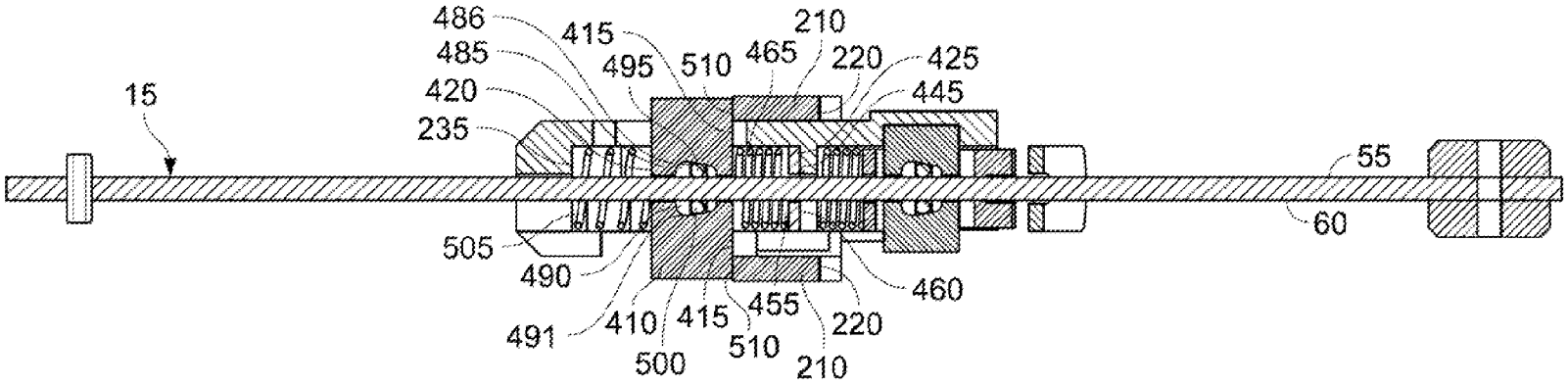
FIG. 15 is a sectional view of FIG. 9.

As illustrated in FIGS. 11, 12 and 14, the driving pin actuator 425 further defines a pair of through pin slots 470 and 475 therein, located opposite of one another about the slider and oriented perpendicular to the pin actuator's through opening 430, while the driving wedge block 410 preferably further defines a through trapezoidal opening 480 (FIG. 13) oriented perpendicular to the driving wedge block's through opening 435. With the driving wedge block 410 located about the slider 15, the wedge block's through trapezoidal opening 480 is bifurcated by the slider to define a pair of through wedge-shaped pockets 485 and 490 (FIG. 15) that are located opposite of one another about the slider 15. The pockets 485 and 490 define opposing angled walls 486 and 491 that toe in towards one another in a forward direction. The respective and opposite wedge-shaped pockets of the driving wedge block and the slots of the pin actuator have respective driving pins 495 and 500 inserted there-though for selective engagement between the wedge block, pin actuator and slider 15.

The angled walls 486 and 491 of the wedge-shaped pockets 485 and 490 taper towards the forward end 415 of the driving wedge block 410 such that each pocket decreases in opening dimension from a size that exceeds the pin diameter to a size that is smaller than the pin diameter. Thus, with the slider 15 located between the pins 495 and 500, a rearward movement of the wedge block, along with the preload force on the driving pin actuator 425 (provided by the compression spring 465 located between the wedge block forward end 415 and the inner contact surface 455 of the driving pin actuator), will draw the pins into the respective pockets 485 and 490 and against the angled walls 486 and 491, and also against the first and second side surfaces 55 and 60 of the slider, to allow the pins to grip and hold the slider as the wedge block moves in a rearward direction.

The pins of the driving grip 405 thus grip the slider 15 when the driving wedge block 410 is moved in a rearward direction and release the slider when the wedge block is moved in a forward direction. A release of the slider 15 occurs when the driving wedge block 410 is moved in the forward direction such that the forward end 445 of the driving pin actuator 425 contacts the forward wall 225 of the drive cavity and the driving wedge block stop surface 422 contacts the rearward end 450 of the driving pin actuator 425. The driving wedge block 410 is biased to the forward direction by a compression spring 505 (FIG. 14), located between the rearward end 420 of the wedge block and the rearward wall 235 of the driving cavity, and moved in the rearward direction by a trigger 180 pivotally related to the clamp housing 20.

In another embodiment, a driving cam actuator is used with the driving wedge block to drive the slider. The driving cam actuator and wedge block each defines respective longitudinal through openings through which the slider extends. The driving cam actuator also defines a driving wedge block recess, perpendicular to the through opening, to accommodate the driving wedge block therein. With the driving wedge block located substantially within the driving cam actuator's wedge block recess, the driving wedge block is thus able to slide back and forth within recess of the cam actuator. The driving cam actuator further defines forward and rearward ends, with the forward end protruding outwardly beyond the forward end of the driving wedge block and preferably defining inner and outer forward contact surfaces.

The rearward end of the driving cam actuator is adapted to engage an inward stop surface defined at the rearward end of the driving wedge block. A compression spring is located between the forward inner contact surface of the driving cam actuator's forward end and the forward end of the driving wedge block such that the driving cam actuator is spring-biased in a forward position in relation to the driving wedge block to provide a pre-load force, to be discussed further. A forward movement of the driving cam actuator in relation to the driving cavity is prevented by the forward wall of the driving cavity (i.e., FIG. 10), which abuts the forward outer contact surface of the driving cam actuator.

The driving cam actuator further defines a pair of forward cam guides and a pair of rearward cam guides therein, with the guides of each pair located opposite of one another about the slider and oriented parallel with the driving cam actuator's through opening. The driving wedge block preferably further defines a cam housing opening oriented perpendicular to the driving wedge block's through opening. The opening of the driving wedge block is configured to accept the insertion of a cam housing therein for rotatably mounting a pair of cams thereto while the driving wedge block further defines opposing cam contact surfaces. With the driving wedge block located about the slider, the wedge block's cam housing opening is bifurcated by the slider such that each cam of the pair of cams and each cam contact surface of the opposing cam contact surfaces is located opposite of one another about the slider. Each cam, located between the slider and respective contact surface, is thus configured for selective engagement between the slider and the respective contact surface of the clamping wedge block. Each cam is pivotally connected to the cam housing via respective posts matingly connected to the housing.

The opposing cam contact surfaces of the driving wedge block are located a predetermined distance from the slider such each cam will interferingly contact both the slider and a respective contact surface. Thus, with the slider located between the cams, a rearward movement of the driving wedge block, along with the preload force on the driving cam actuator (provided by the compression spring located between the wedge block forward end and the inner contact surface of the driving cam actuator), will move the cams against the opposing contact surfaces, and also against the first and second side surfaces of the slider to allow the cams to grip and hold the slider as the wedge block moves in a rearward direction.

The cams of the driving grip thus grip the slider when the driving wedge block is moved in a rearward direction and release the slider when the wedge block is moved in a forward direction. A release of the slider occurs when the driving wedge block is moved in the forward direction such that the forward end of the driving cam actuator contacts the forward wall of the drive cavity and the driving wedge block stop surface contacts the rearward end of the driving cam actuator. The driving wedge block is biased to the forward direction by a compression spring, located between the rearward end of the wedge block and the rearward wall of the driving cavity, and moved in the rearward direction by a trigger pivotally related to the clamp housing.

In yet another embodiment, a driving ball actuator is used with the driving wedge block to drive the slider. The driving ball actuator and wedge block each defines respective longitudinal through openings through which the slider extends. The driving ball actuator also defines a driving wedge block recess, perpendicular to the through opening, to accommodate the driving wedge block therein. With the driving wedge block located substantially within the driving ball actuator's wedge block recess, the driving wedge block is thus able to slide back and forth within recess of the ball actuator. The driving ball actuator further defines forward and rearward ends, with the forward end protruding outwardly beyond the forward end of the driving wedge block and preferably defining inner and outer forward contact surfaces.

The rearward end of the driving ball actuator is adapted to engage an inward stop surface defined at the rearward end of the driving wedge block. A compression spring is located between the forward inner contact surface of the driving ball actuator's forward end and the forward end of the driving wedge block such that the driving ball actuator is spring-biased in a forward position in relation to the driving wedge block to provide a pre-load force, to be discussed further. A forward movement of the driving ball actuator in relation to the driving cavity is prevented by the forward wall of the driving cavity (i.e., FIG. 10), which abuts the forward outer contact surface of the driving ball actuator.

The driving ball actuator further defines a pair of forward ball guides and a pair of rearward ball guides therein, with the guides of each pair located opposite of one another about the slider and oriented parallel with the driving ball actuator's through opening. The driving wedge block preferably further defines a ball housing opening oriented perpendicular to the driving wedge block's through opening. The opening of the driving wedge block is configured to accept the insertion of a ball housing therein, for rotatably securing a pair of balls within the wedge block, while the wedge block further defines opposing ball angled contact surfaces that toe in towards one another in a forward direction.

With the driving wedge block located about the slider, the wedge block's ball housing opening is bifurcated by the slider such that each ball of the pair of balls and each ball angled contact surface of the opposing ball angled contact surfaces is located opposite of one another about the slider. The angled walls taper towards the forward end of the driving wedge block such that respective pockets are defined that decrease in opening dimension from a size that exceeds the ball diameter to a size that is smaller than the ball diameter.

Thus, with the slider located between the balls, a rearward movement of the driving wedge block, along with the preload force on the driving ball actuator (provided by the compression spring located between the wedge block forward end and the inner contact surface of the driving ball actuator), will move the balls against the angled contact surfaces, and also against the first and second side surfaces of the slider to allow the balls to grip and hold the slider as the wedge block moves in a rearward direction.

The balls of the driving grip thus grip the slider when the driving wedge block is moved in a rearward direction and release the slider when the wedge block is moved in a forward direction. A release of the slider occurs when the driving wedge block is moved in the forward direction such that the forward end of the driving ball actuator contacts the forward wall of the drive cavity and the driving wedge block stop surface contacts the rearward end of the driving ball actuator. The driving wedge block is biased to the forward direction by a compression spring, located between the rearward end of the wedge block and the rearward wall of the driving cavity, and moved in the rearward direction by a trigger pivotally related to the clamp housing.

Referring again to FIGS. 10 and 11, the trigger 180 is movable between depressed and released positions such that the pins, cams or balls of the driving grip 405 engage and drive the slider 15 when the trigger is in the depressed position and release the slider when the trigger is in the released position. Defining upper and lower ends 185 and 190 and forward and rearward sides 195 and 200, the trigger is comprised of any number of rigid materials, to include metals, plastics, resin-based composite materials and other materials having rigid properties. In a preferred embodiment of the invention, the trigger is comprised of plastic.

A recess 205 (FIG. 11) extends downwardly from the trigger's upper end 185 to define a pair of arcuate pivot surfaces 210, extending from the forward side 195 of the trigger at the trigger's upper end, and a pair of engagement surfaces 510 extending from the rearward side 200 of the trigger, also at the trigger's upper end. A grip surface 215 extends upwardly from the trigger's lower end 190 on the trigger's forward side as well. The pivot surfaces 210 of the trigger are configured for pivoting engagement with a pivot receiver 220 (FIG. 9) defined in the housing's body 135 and/or cover 110 while the grip surface 215 is configured to be gripped by the hand of a user of the clamp. The engagement surfaces 510 of the rearward side 200 of the trigger 180 are configured to engage the forward end 415 of the driving wedge block 410 about the slider, at the at the trigger's upper end 185, such that the slider 15 extends through both the through driving lever's opening 165 and the trigger's recess 205.

When the trigger 180 is in the released position, the pins, cams or balls of the driving grip 405 are substantially disengaged from the slider 15. When the trigger is depressed, its pivot surfaces 210 pivot within the receiver 220 of the housing and cover, thus causing the trigger's engagement surfaces to move the driving wedge block in a rearward direction to cause the pins, cams or balls to engage and grip the slider 15. When the trigger is further depressed, the pivot surfaces 210 further pivot within the receiver 220 of the housing and cover, thus causing the driving wedge grip and pins, cams or balls to drive the slider in a rearward direction in relation to the housing. Upon a release of the trigger, a compression spring 505, located between the rear end 420 of the wedge block 410 and a rear, inward surface 235 of the driving cavity, is biased to move the block in a forward direction to draw the pins away from the angled walls 486 and 491 to release the frictional contact between the pins and slider.

Upon a release of the trigger, a compression spring, located between the rear end of the driving wedge block and a rear, inward surface of the driving cavity, is similarly biased to move the block in a forward direction to move the cams away from the opposing contact surfaces or the balls away from the angled contact surface to release the frictional contact between the cams or balls and slider. Again, this forward direction results in the driving pin actuator 425 contacting the forward wall 225 of the drive cavity and the driving wedge block stop surface 422 contacting the rearward end 450 of the driving pin actuator 425. Similarly, this forward direction results in the driving cam or ball actuator contacting the forward wall of the drive cavity and the driving wedge block stop surface contacting the rearward end of the driving cam or ball actuator.

Again, if the first jaw 10 of the clamp is secured to the forward end 75 of the slider 15 such that the respective jaw surfaces of the first and second jaws face towards one another, the respective jaw surfaces will move towards one another (to grip an article there-between) as the trigger drives the slider in the rearward direction. Likewise, if the first jaw 10 of the clamp is secured to the rearward end 70 of the slider 15 such that the respective jaw surfaces of the first and second jaws face away from one another, the respective jaw surfaces will move away from one another (to function as a spreading device) as the trigger drives the slider in the rearward direction.

Figures 16A, 16B:
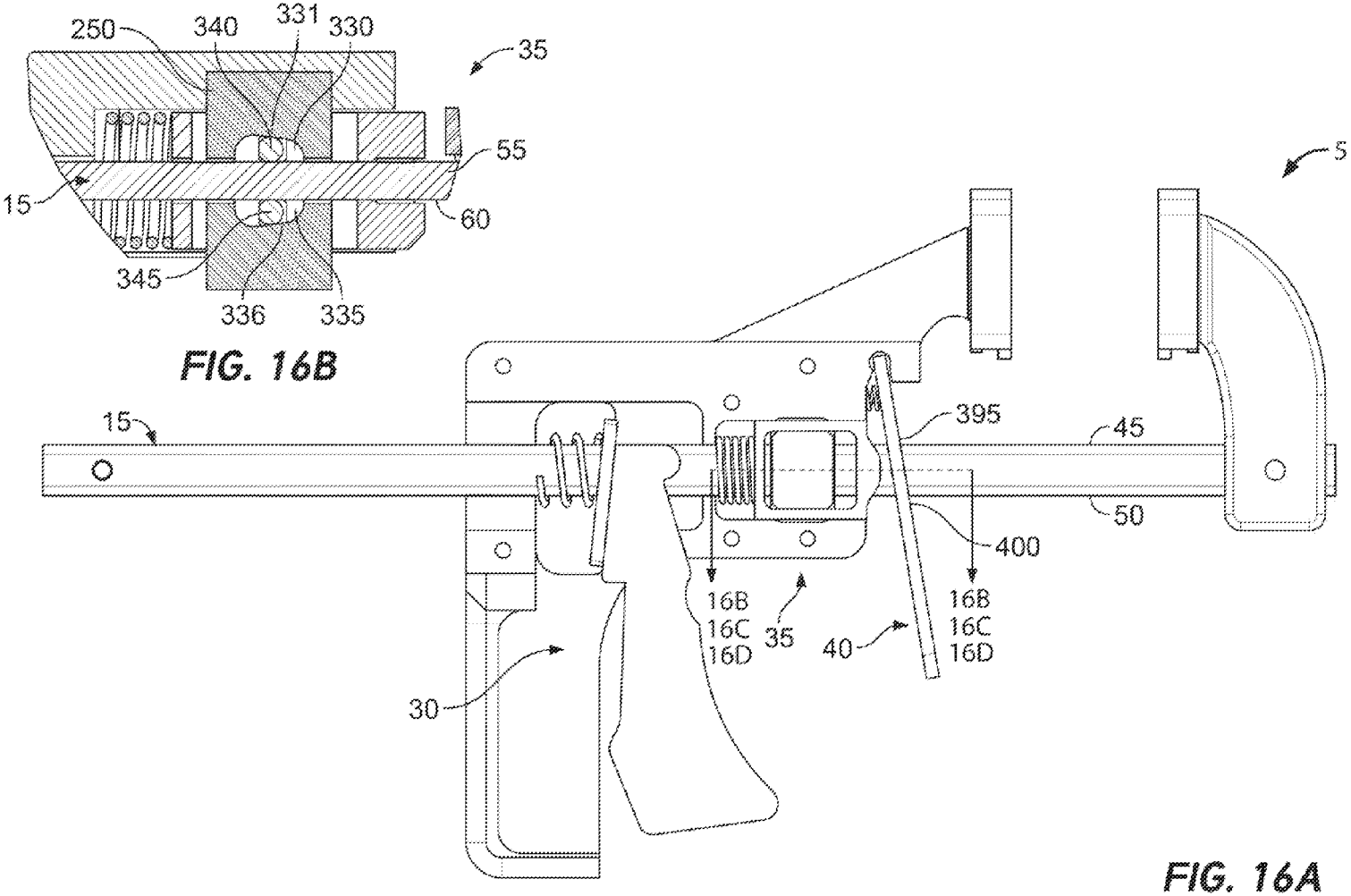
FIG. 16A is an elevation view of the components of the clamp of FIG. 1 in the engaged position.
FIG. 16B is a sectional view of the clamping mechanism of the clamp of FIG. 16A.
Figure 16D:
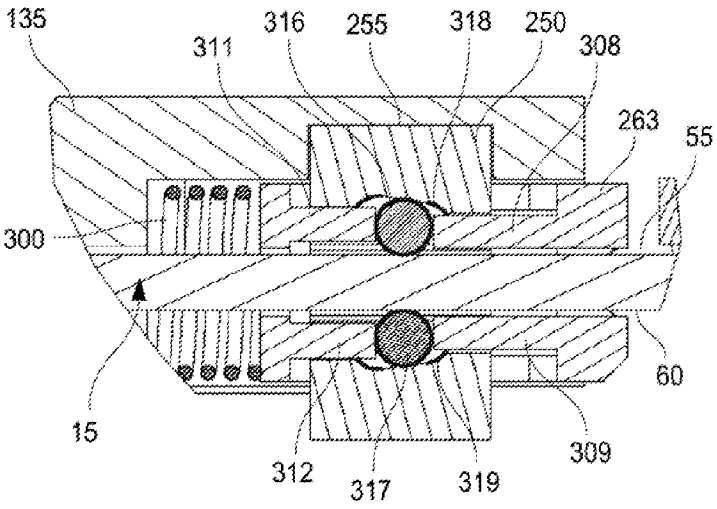
FIG. 16D is a sectional view of another alternate embodiment of the clamping mechanism of the clamp of FIG. 16A.
Figure 16C:
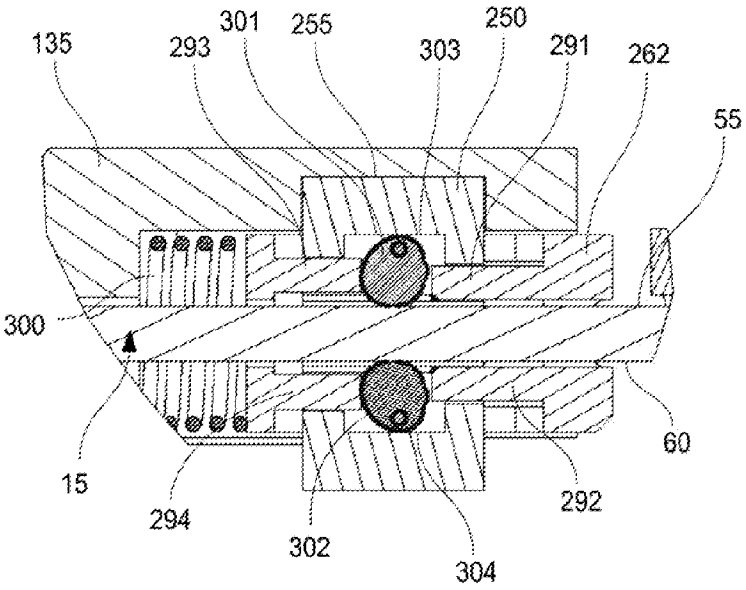
FIG. 16C is a sectional view of an alternate embodiment clamping mechanism of the clamp of FIG. 16A.
Figures 18A, 18B:
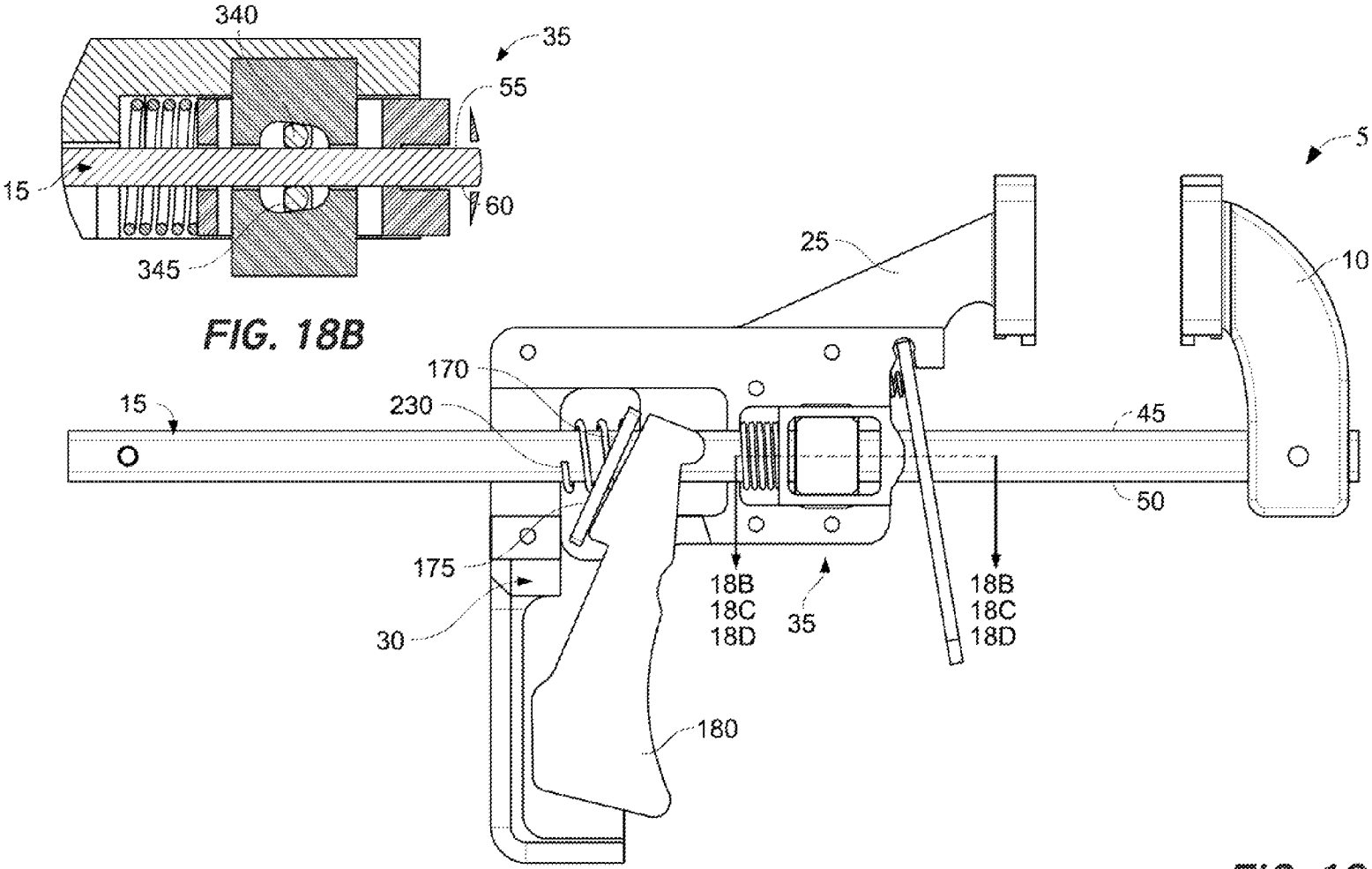
FIG. 18A is an elevation view of the components of the clamp of FIG. 1 in the clamping position.
FIG. 18B is a sectional view of the clamping mechanism of the clamp of FIG. 18A.
Figure 18D:
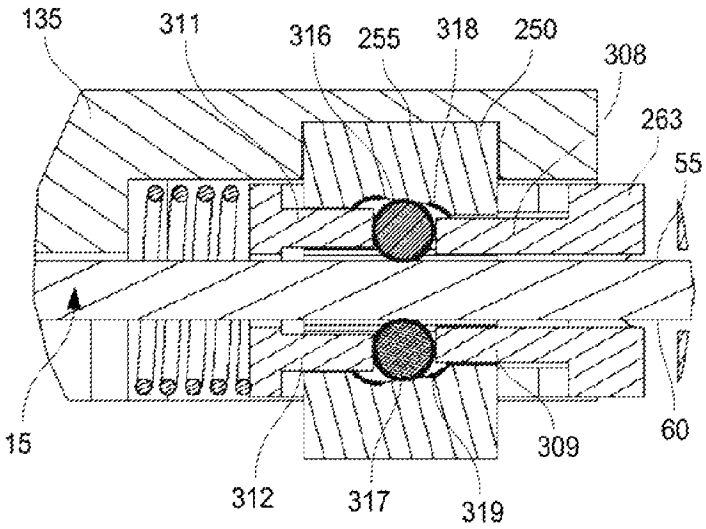
FIG. 18D is a sectional view of another alternate embodiment of the clamping mechanism of the clamp of FIG. 18A.
Figure 18C:
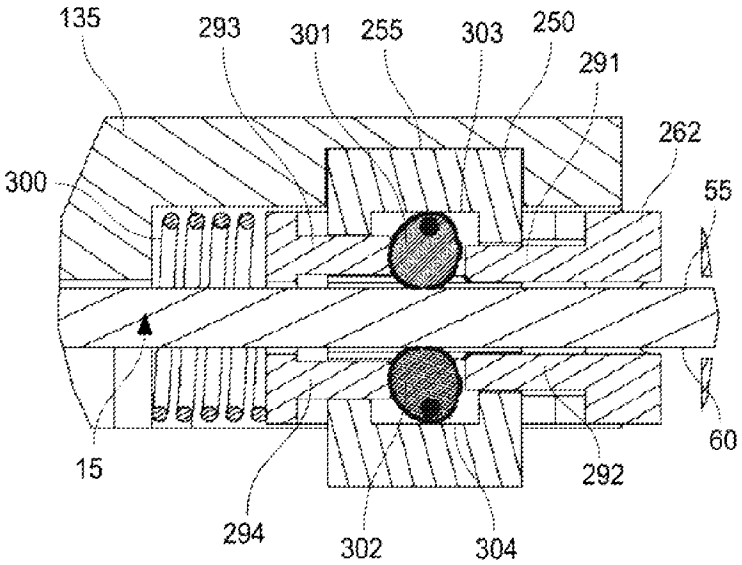
FIG. 18C is a sectional view of an alternate embodiment of the clamping mechanism of the clamp of FIG. 18A.
Figure 19A:
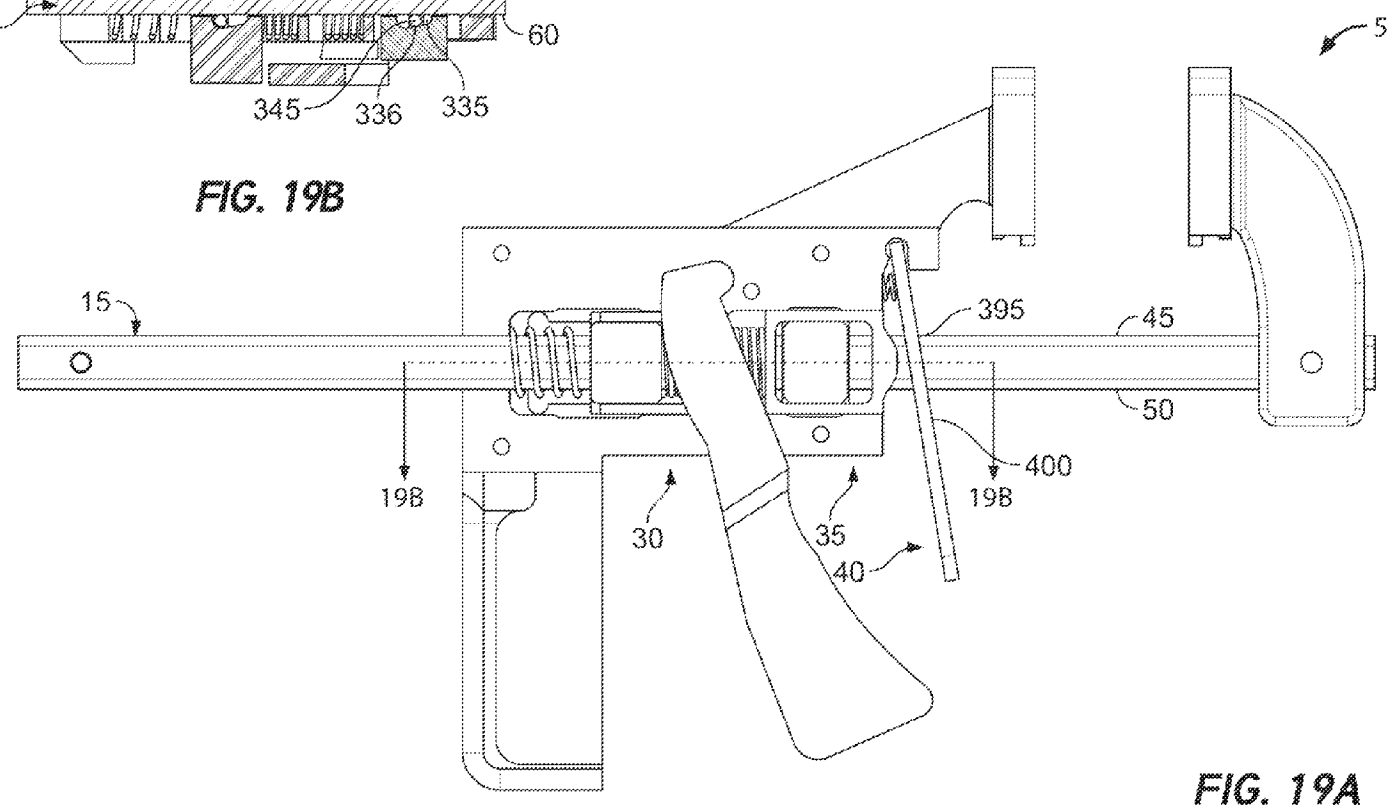
FIG. 19A is an elevation view of the components of the clamp of FIG. 9 in the engaged position.
Figure 19B:
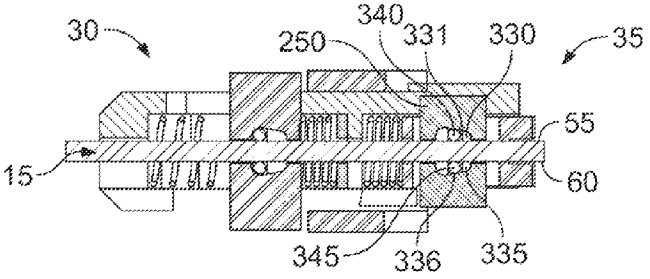
FIG. 19B is a sectional view of the driving and clamping mechanisms of the clamp of FIG. 19A.
Figure 20A:
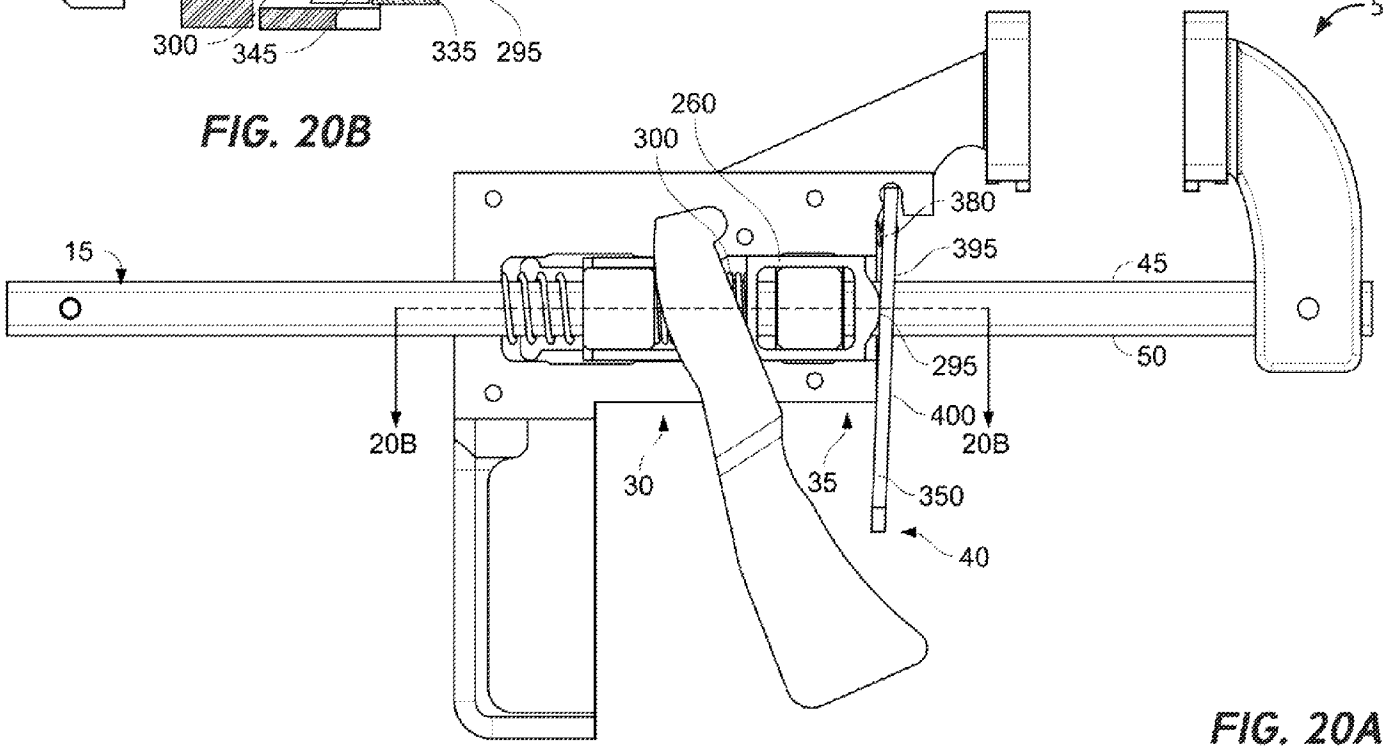
FIG. 20A is an elevation view of the components of the clamp of FIG. 9 in the released position.
Figure 20B:
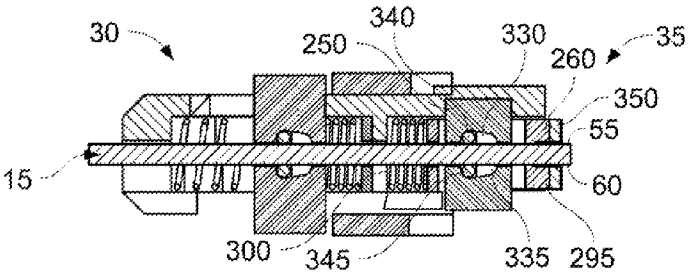
FIG. 20B is a sectional view of the driving and clamping mechanisms of the clamp of FIG. 20A.
Figure 21A:
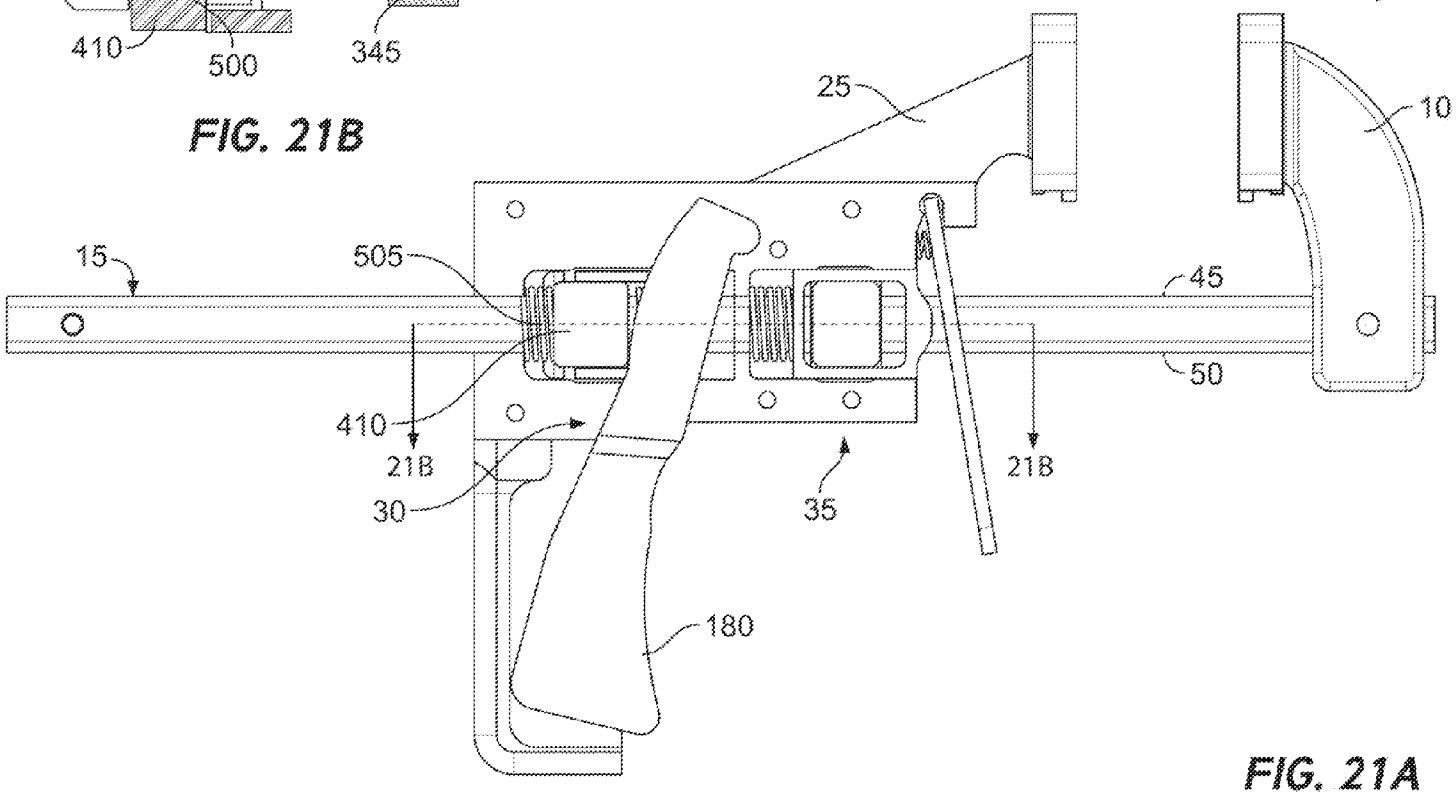
Figure 21B:
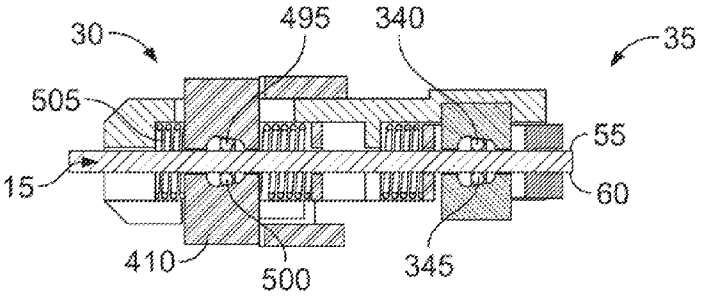
FIG. 21B is a sectional view of the driving and clamping mechanisms of the clamp of FIG. 21A.

In use in both embodiments of the clamp illustrated respectively in FIGS. 1-8 (driving mechanism 30 is driving lever grip 145) and FIGS. 9-15 (driving mechanism 30 is driving wedge grip 405), clamp 5 is operable between engaged, released and driving positions, as illustrated in FIGS. 16-18 (driving mechanism 30 is driving lever grip 145) and FIGS. 19-21 (driving mechanism 30 is driving wedge grip 405). Referring initially to FIGS. 16A-C and 19, the clamp 5 is in the engaged position such that the clamping mechanism 35 is gripping the slider 15 to prevent the slider from moving in a forward direction. When in the engaged position, the clamp is typically gripping an article between the clamp's jaws while the drive mechanism is not actuated. For the sake of clarity, however, no article is illustrated between the clamp's jaws.

In one embodiment of the clamping mechanism 35 gripping the slider (FIG. 16B), the pins 340 and 345 of the clamping mechanism are wedged between the angled surfaces 331 and 336 (of the wedge-shaped pockets 330 and 335 of the wedge block 250) and the slider's first and second side surfaces 55 and 60 to prevent any forward movement of the slider (i.e., to brake the slider).

In another embodiment of the clamping mechanism 35 gripping the slider (FIG. 16C), with the slider 15 located between the cams 301 and 302, a forward movement of the slider, along with force from the compression spring 300 against the clamping cam actuator 262 to provide a preload to the cams via the rearward cam guides 293 and 294, will move the cams against the opposing contact surfaces 303 and 304, and also against the first and second side surfaces 55 and 60 of the slider, to prevent any forward movement of the slider (i.e., to brake the slider).

In yet another embodiment of the clamping mechanism 35 gripping the slider (FIG. 16D), with the slider 15 located between the balls 316 and 317, a forward movement of the slider, along with force from the compression spring 300 against the clamping ball actuator 263 to provide a preload via the rearward ball guides 311 and 312, will move the balls into the respective pockets 312 and 322 and against the angled contact surfaces 318 and 319, and also against the first and second side surfaces 55 and 60 of the slider, to prevent any forward movement of the slider (i.e., to brake the slider).

Figures 17A, 17B:
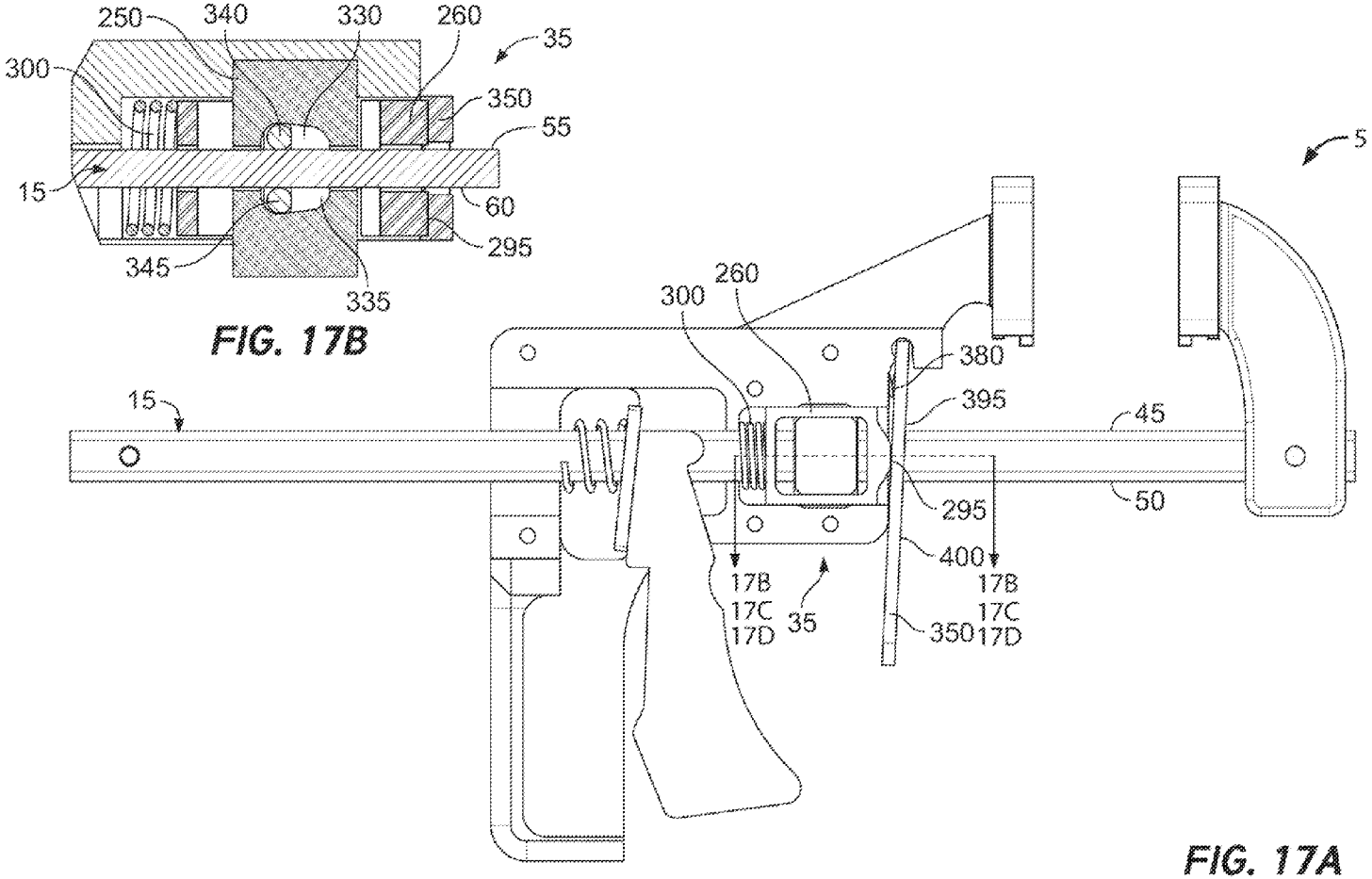
FIG. 17A is an elevation view of the components of the clamp of FIG. 1 in the released position.
FIG. 17B is a sectional view of the clamping mechanism of the clamp of FIG. 17A.
Figure 17D:
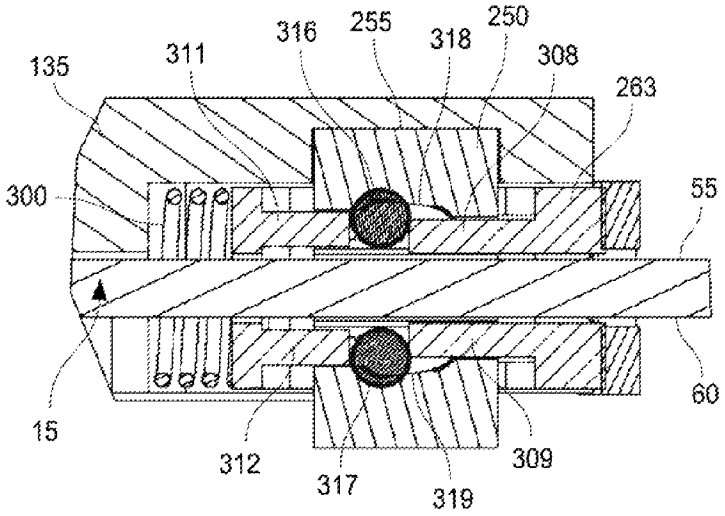
FIG. 17D is a sectional view of another alternate embodiment of the clamping mechanism of the clamp of FIG. 17A.
Figure 17C:
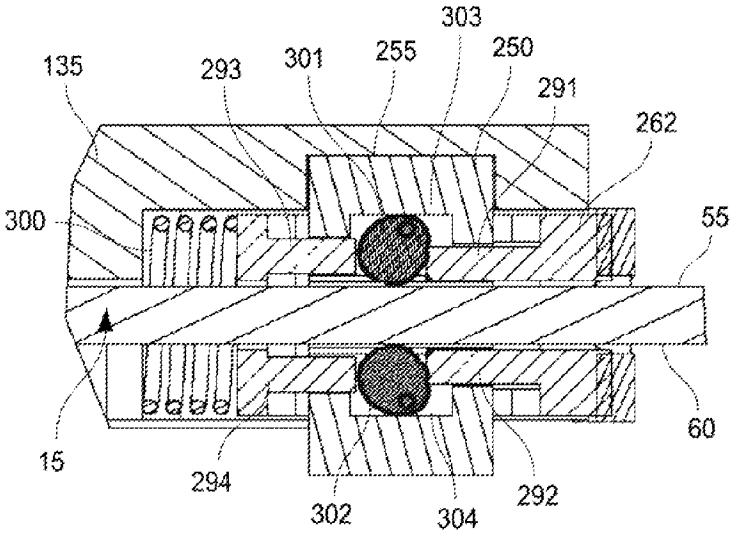
FIG. 17C is a sectional view of an alternate embodiment of the clamping mechanism of the clamp of FIG. 17A.

To release the clamp, as illustrated in FIGS. 17A-B and 20 in one embodiment of the clamping mechanism 35, the release lever 350 of the release mechanism 40 is pivoted in a rearward direction until it contacts the bull-nose contact surface 295 of the clamping mechanism's pin actuator 260. The release lever 350 is then further pivoted in a rearward direction to slide the pin actuator 260 in a rearward direction, thus drawing the pins 340 and 345 in a rearward direction within the wedge-shaped pockets 330 and 335 and out of frictional contact from the sides 55 and 60 of the slider. The slide bar 15 can now be moved freely in the forward and rearward direction.

To release the clamp in another embodiment of the clamping mechanism 35 (FIG. 17C) to allow the slider 15 and allow to move in a forward direction again, the cam actuator 262 is slidingly moved in a rearward direction to move the cams 301 and 302 away from the respective opposing contact surfaces 303 and 304 and away from the slider via the pair of forward cam guides 291 and 292.

To release the clamp in yet another embodiment of the clamping mechanism 35 (FIG. 17D) to allow the slider 15 and allow to move in a forward direction again, the ball actuator 263 is slidingly moved in a rearward direction to draw the balls 316 and 317 out of the respective pockets 321 and 322, away from the angled contact surfaces 318 and 319 and away from the slider, all via the pair of forward ball guides 308 and 309.

Upon a release of the release lever 350, as illustrated in the embodiment of FIGS. 18A-B, the pin actuator compression spring 300 thereafter moves the pin actuator 260 in a forward direction, to again prevent the slider 15 from moving in a forward direction, while the release lever compression spring 380 moves the release lever 350 in a forward direction again.

Upon a release of the release lever 350, as illustrated in the embodiment of FIG. 18C, the compression spring 300 biases the cam actuator 262 in a forwardly direction to force the cams against the slider via the rearward cam guides 293 and 294 to bias the clamping wedge grip 245 to brake and hold the slider 15 again for selective release.

Upon a release of the release lever 350, as illustrated in the embodiment of FIG. 18D, the compression spring 300 biases the ball actuator 263 in a forwardly direction to force the balls against the slider via the rearward ball guides 311 and 312 to bias the clamping wedge grip 245 to again brake and hold the slider 15 for selective release.

To drive the jaws of the device 5 in embodiments of the clamp utilizing the driving lever grip as the driving mechanism 30, as illustrated in FIG. 18, the trigger 180 is pivoted in a rearward direction to move the upper and lower inner surfaces 170 and 175 of the driving lever's through opening 165 into frictional contact with the upper and lower surfaces 45 and 50 of the slider 15. The trigger 180 is then further pivoted in a rearward direction to drive the slider 15 in a rearward direction, thus drawing the first jaw 10 of the clamp towards the second jaw 25. The trigger compression spring 230 thereafter moves the trigger in a forward direction to the position illustrated in FIG. 16. At this point, the pins 340 and 345 of the clamping mechanism 35 will again engage the bar 15 to prevent any forward movement of the bar.

To drive the jaws of the device 5 in embodiments of the clamp utilizing a driving wedge grip as the driving mechanism 30, as illustrated in the embodiment of FIG. 21, the trigger 180 is pivoted in a rearward direction to move the driving wedge block 410 in a rearward direction to cause the pins 495 and 500 to come into frictional contact with the side surfaces 55 and 60 of the slider 15. The trigger 180 is then further pivoted in a rearward direction to drive the slider 15 in a rearward direction, thus drawing the first jaw 10 of the clamp towards the second jaw 25. Upon a release of the trigger 180 by the user, the compression spring 505 thereafter moves the driving wedge block 410 and trigger in the forward direction to the position illustrated in FIG. 19. At this point, the pins 340 and 345 of the clamping mechanism 35 will again engage the bar 15 to prevent any forward movement of the bar.

To drive the jaws of the device in another embodiment of the clamp utilizing a driving wedge grip as the driving mechanism, the trigger is pivoted in a rearward direction to move the driving wedge block in a rearward direction to cause the cams to come into frictional contact with the side surfaces of the slider. The trigger is then further pivoted in a rearward direction to drive the slider in a rearward direction, thus drawing the first jaw of the clamp towards the second jaw. Upon a release of the trigger by the user, the compression spring thereafter moves the driving wedge block and trigger in the forward direction to the position illustrated in FIG. 19. At this point, the cams of the clamping mechanism will again engage the bar to prevent any forward movement of the bar.

To drive the jaws of the device in yet another embodiment of the clamp utilizing a driving wedge grip as the driving mechanism, the trigger is pivoted in a rearward direction to move the driving wedge block in a rearward direction to cause the balls to come into frictional contact with the side surfaces of the slider. The trigger is then further pivoted in a rearward direction to drive the slider in a rearward direction, thus drawing the first jaw of the clamp towards the second jaw. Upon a release of the trigger by the user, the compression spring thereafter moves the driving wedge block and trigger in the forward direction to the position illustrated in FIG. 19. At this point, the balls of the clamping mechanism will again engage the bar to prevent any forward movement of the bar.

While this foregoing description and accompanying figures are illustrative of the present invention, other variations in structure and method are possible without departing from the invention's spirit and scope. For example, both the clamping and driving wedge grips could utilize additional pairs of opposing pins, cams or balls, alone or in combination, to act as a clamping backup or to create additional gripping and/or driving power.

We claim:

1. A bar clamp comprising:

a first jaw connected to a slider;

a clamp housing and second jaw operably associated with the slider;

a driving mechanism operably associated with the housing and slider to drive the slider;

a clamping wedge grip operably associated with the housing and slider to brake the slider; and a release mechanism operably associated with the clamping wedge grip and slider to release the slider, the clamping wedge grip comprising a clamping wedge block and a clamping actuator, the actuator in operable relation with the wedge block, slider, and release mechanism to brake and release the slider.

2. A bar clamp comprising:

a first jaw connected to a slider;

a clamp housing and second jaw operably associated with the slider;

a driving mechanism operably associated with the housing and slider to drive the slider;

a clamping wedge grip operably associated with the housing and slider to brake the slider; and a release mechanism operably associated with the clamping wedge grip and slider to release the slider, the clamping wedge grip comprising a clamping wedge block and a clamping actuator, the actuator in operable relation with the wedge block and release mechanism to actuate pins operably associated with the slider.

3. The bar clamp of claim 2 wherein the clamping wedge block is in securement with the housing and the clamping actuator is in sliding relation with the clamping wedge block, the clamping wedge block and the actuator each defining a through opening and having the slider located there-through, the clamping actuator further defining a pair of slots therein located opposite of one another about the slider and the clamping wedge block further defining a through opening that is bifurcated by the slider to define a pair of wedge-shaped pockets therein located opposite of one another about the slider, the respective opposite wedge-shaped pockets and slots having the pins inserted there-though for selective engagement between the clamping wedge block, clamping actuator and slider.

4. A bar clamp comprising:

a first jaw connected to a slider;

a clamp housing and second jaw operably associated with the slider;

a driving mechanism operably associated with the housing and slider to drive the slider;

a clamping wedge grip operably associated with the housing and slider to brake the slider; and a release mechanism operably associated with the clamping wedge grip and slider to release the slider, the clamping wedge grip comprising a clamping wedge block and a clamping actuator, the actuator in operable relation with the wedge block and release mechanism to actuate cams operably associated with the slider.

5. The bar clamp of claim 4 wherein the clamping wedge block is in securement with the housing and the clamping actuator is in sliding relation with the clamping wedge block, the clamping wedge block and the actuator each defining a through opening and having the slider located there-through, the clamping actuator further defining a pair of forward cam guides and a pair of rearward cam guides therein, the guides of each pair located opposite of one another about the slider and oriented parallel with the clamping actuator's through opening, the clamping wedge block further defining a cam housing opening oriented perpendicular to the wedge block's through opening and configured to accept the insertion of a cam housing therein, the wedge block further defining opposing cam contact surfaces and the housing having the cams rotatably mounted thereto for selective engagement between the clamping wedge block, clamping actuator and slider.

6. A bar clamp comprising:

a first jaw connected to a slider;

a clamp housing and second jaw operably associated with the slider;

a driving mechanism operably associated with the housing and slider to drive the slider;

a clamping wedge grip operably associated with the housing and slider to brake the slider; and a release mechanism operably associated with the clamping wedge grip and slider to release the slider, the clamping wedge grip comprising a clamping wedge block and a clamping actuator, the actuator in operable relation with the wedge block and release mechanism to actuate balls operably associated with the slider.

7. The bar clamp of claim 6 wherein the clamping wedge block is in securement with the housing and the clamping actuator is in sliding relation with the clamping wedge block, the clamping wedge block and the actuator each defining a through opening and having the slider located there-through, the clamping actuator further defining a pair of forward ball guides and a pair of rearward ball guides therein, the guides of each pair located opposite of one another about the slider and oriented parallel with the clamping actuator's through opening, the clamping wedge block further defines a ball housing opening oriented perpendicular to the wedge block's through opening and configured to accept the insertion of a ball housing therein for rotatably securing the balls within the wedge block, the wedge block further defining opposing ball angled contact surfaces that toe in towards one another in a forward direction, the balls configured for selective engagement between the clamping wedge block, clamping actuator and slider.

8. A bar clamp comprising:

a first jaw connected to a slider;

a clamp housing and second jaw operably associated with the slider;

a driving wedge grip operably associated with the housing and slider to drive the slider, the driving wedge grip comprising a driving wedge block and a driving actuator, the actuator in operable relation with the wedge block and the slider; and a clamping wedge grip operably associated with the housing and slider to brake the slider.

9. A bar clamp comprising:

a first jaw connected to a slider;

a clamp housing and second jaw operably associated with the slider;

a driving wedge grip operably associated with the housing and slider to drive the slider, the driving wedge grip comprising a driving wedge block and a driving actuator, the actuator in operable relation with the wedge block and the slider to actuate pins operably associated with the slider; and a clamping wedge grip operably associated with the housing and slider to brake the slider.

10. The bar clamp of 9 wherein the driving wedge block is slidingly related to both the housing and the driving actuator, the driving wedge block and the actuator each defining a through opening and having the slider located there-through, the driving actuator further defining a pair of slots therein located opposite of one another about the slider and the driving wedge block further defining a through opening that is bifurcated by the slider to define a pair of wedge-shaped pockets therein located opposite of one another about the slider, the respective opposite wedge-shaped pockets and slots having the pins inserted there-though for selective engagement between the driving wedge block, driving actuator and slider.

11. A bar clamp comprising:

a first jaw connected to a slider;

a clamp housing and second jaw operably associated with the slider;

a driving wedge grip operably associated with the housing and slider to drive the slider, driving wedge grip comprising a driving wedge block and a driving actuator, the actuator in operable relation with the wedge block and the slider to actuate cams operably associated with the slider; and a clamping wedge grip operably associated with the housing and slider to brake the slider.

12. A bar clamp comprising:

a first jaw connected to a slider;

a clamp housing and second jaw operably associated with the slider;

a driving wedge grip operably associated with the housing and slider to drive the slider, the driving wedge grip comprising a driving wedge block and a driving actuator, the actuator in operable relation with the wedge block and the slider to actuate balls operably associated with the slider; and a clamping wedge grip operably associated with the housing and slider to brake the slider.

13. A method of using a bar clamp having a slider connecting two jaws and operable between engaged, released and driving positions, the method comprising:

actuating a release mechanism to release a clamping wedge grip from engagement with the slider;

actuating a driving mechanism to drive the slider to a desired position for engagement; and actuating the clamping wedge grip to again engage the slider, wherein releasing the clamping wedge grip comprises sliding a clamping actuator to move a pair of pins within a clamping wedge block out of frictional contact with the slider and wherein actuating the clamping wedge grip comprises sliding the clamping actuator to move the pair of pins within the clamping wedge block into frictional contact with the slider.

14. The method of claim 13 wherein actuating the driving mechanism comprises actuating a driving wedge grip operably associated with the housing and slider to drive the slider, the driving wedge grip comprising a driving wedge block and a driving actuator, the driving actuator in operable relation with the driving wedge block and the slider.

15. A method of using a bar clamp having a slider connecting two jaws and operable between engaged, released and driving positions, the method comprising:

actuating a release mechanism to release a clamping wedge grip from engagement with the slider;

actuating a driving mechanism to drive the slider to a desired position for engagement; and actuating the clamping wedge grip to again engage the slider, wherein releasing the clamping wedge grip comprises sliding a clamping actuator to move a pair of cams within a clamping wedge block out of frictional contact with the slider and wherein actuating the clamping wedge grip comprises sliding the clamping actuator to move the pair of cams within the clamping wedge block into frictional contact with the slider.

16. A method of using a bar clamp having a slider connecting two jaws and operable between engaged, released and driving positions, the method comprising:

actuating a release mechanism to release a clamping wedge grip from engagement with the slider;

actuating a driving mechanism to drive the slider to a desired position for engagement; and actuating the clamping wedge grip to again engage the slider, wherein releasing the clamping wedge grip comprises sliding a clamping actuator to move a pair of balls within a clamping wedge block out of frictional contact with the slider and wherein actuating the clamping wedge grip comprises sliding the clamping actuator to move the pair of balls within the clamping wedge block into frictional contact with the slider.

* * * * *